US008899089B1

(12) United States Patent
Shinjo

(10) Patent No.: US 8,899,089 B1
(45) Date of Patent: Dec. 2, 2014

(54) APPARATUS TO PRODUCE SELF-PIERCING AND CLINCH NUT AND METHOD FOR PRODUCING SELF-PIERCING AND CLINCH NUT

(71) Applicant: Shinjo Manufacturing Co., Ltd., Kishiwada-shi (JP)

(72) Inventor: Tadashi Shinjo, Kishiwada (JP)

(73) Assignee: Shinjo Manufacturing Co., Ltd., Kishiwada-Shi (JP)

( * ) Notice: Subject to any disclaimer, the term of this patent is extended or adjusted under 35 U.S.C. 154(b) by 0 days.

(21) Appl. No.: 14/447,572

(22) Filed: Jul. 30, 2014

(30) Foreign Application Priority Data

Jul. 1, 2014 (JP) ..... 2014-135592

(51) Int. Cl.

| | |
|---|---|
| ***B21D 53/24*** | (2006.01) |
| ***B21D 28/02*** | (2006.01) |
| ***B21D 22/02*** | (2006.01) |
| ***B21D 35/00*** | (2006.01) |

(52) U.S. Cl.
CPC ..... *B21D 53/24* (2013.01); *B21D 28/02* (2013.01); *B21D 22/02* (2013.01); *B21D 35/001* (2013.01)
USPC ..... 72/325; 470/87; 470/89; 470/91

(58) Field of Classification Search
CPC ..... B21D 37/08; B21D 53/24; B21K 1/64
USPC ..... 470/87, 89, 91; 72/325
See application file for complete search history.

(56) References Cited

U.S. PATENT DOCUMENTS

| | | | | |
|---|---|---|---|---|
| 5,340,251 | A * | 8/1994 | Takahashi et al. | 411/179 |
| 5,618,237 | A * | 4/1997 | Shinjo | 470/91 |
| 7,131,311 | B1 * | 11/2006 | Kihara et al. | 72/359 |
| 7,314,417 | B2 * | 1/2008 | Babej et al. | 470/25 |
| 2012/0316001 | A1 * | 12/2012 | Shinjo | 470/87 |

FOREIGN PATENT DOCUMENTS

| | | | |
|---|---|---|---|
| JP | 08-029392 | B2 | 7/1995 |
| JP | 5325934 | B2 | 12/2012 |

* cited by examiner

*Primary Examiner* — Shelley Self
*Assistant Examiner* — Gregory Swiatocha
(74) *Attorney, Agent, or Firm* — Mori & Ward, LLP

(57) ABSTRACT

An apparatus to produce a self-piercing and clinch nut includes a first forging die assembly, a second forging die assembly, a third forging die assembly, a transfer mechanism, and a controller. The first forging die assembly is configured to subject a blank to first processing. The second forging die assembly is adjacent to the first forging die assembly and configured to subject the blank to second processing after the blank has undergone the first processing in the first forging die assembly. The third forging die assembly is adjacent to the second forging die assembly and configured to subject the blank to third processing after the blank has undergone the second processing in the second forging die assembly. The controller is configured to control the first forging die assembly, the second forging die assembly, the third forging die assembly, and the transfer mechanism to operate.

12 Claims, 28 Drawing Sheets

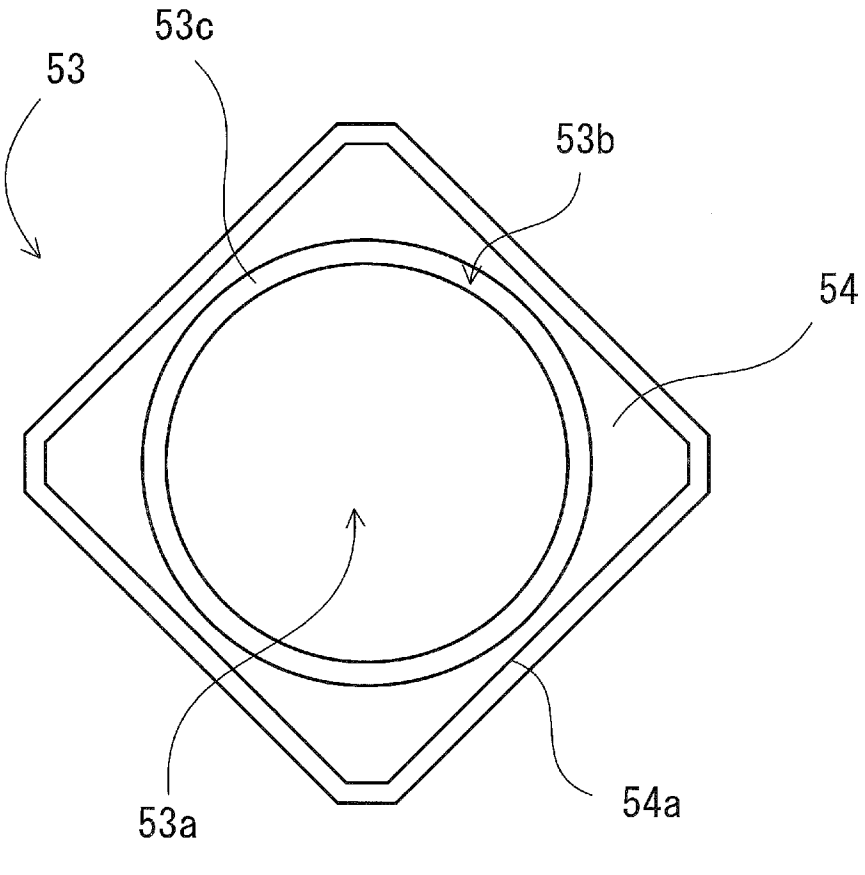
FIG. 18
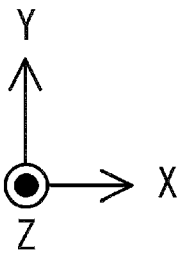

APPARATUS TO PRODUCE SELF-PIERCING AND CLINCH NUT AND METHOD FOR PRODUCING SELF-PIERCING AND CLINCH NUT

CROSS-REFERENCE TO RELATED APPLICATIONS

The present application claims priority under 35 U.S.C. §119 to Japanese Patent Application No. 2014-135592, filed on Jul. 1, 2014. The contents of this application are incorporated herein by reference in their entirety.

BACKGROUND OF THE INVENTION

1. Field of the Invention

The present invention relates to an apparatus to produce a self-piercing and clinch nut and a method for producing a self-piercing and clinch nut.

2. Discussion of the Background

Japanese Examined Patent Publication No. 08-029392 and Japanese Patent No. 5325934 disclose an apparatus to produce a self-piercing and clinch nut by forging.

A self-piercing and clinch nut is secured on a parent material, which is a material such as a steel sheet to accept the self-piercing and clinch nut, in the following manner. First, a hole is punched in the parent material by a pilot portion of the self-piercing and clinch nut. At the same time, part of the parent material is deformed to fill a gap between the pilot portion and a surrounding wall (rib) of the self-piercing and clinch nut. Thus, the parent material is clinched by the nut, and the nut is firmly secured on the parent material. This indicates that dimensional precision of the pilot portion and the surrounding wall of the nut is a critical factor that determines how firmly the self-piercing and clinch nut is secured.

SUMMARY OF THE INVENTION

According to one aspect of the present invention, an apparatus to produce a self-piercing and clinch nut includes a first forging die assembly, a second forging die assembly, a third forging die assembly, a transfer mechanism, and a controller. The first forging die assembly is configured to subject a blank to first processing. The first forging die assembly includes a first die, a first cylindrical insert, a first punch, and a first pin. The first die includes a first insert hole and a first inner peripheral wall defining the first insert hole. The first cylindrical insert includes a first platform. The first cylindrical insert is fitted in the first insert hole with the first platform opposed to the blank so as to define a first processing space in which the blank is to be processed. The first platform includes a first side wall. The first side wall and the first inner peripheral wall define a first surrounding groove. The first punch is movable to and away from the first processing space. The first pin is fitted in a first hole of the first cylindrical insert. The second forging die assembly is adjacent to the first forging die assembly and configured to subject the blank to second processing after the blank has undergone the first processing in the first forging die assembly. The second forging die assembly includes a second die, a second cylindrical insert, and a second punch. The second die includes a second insert hole and a second inner peripheral wall defining the second insert hole. The second cylindrical insert includes a second platform. The second cylindrical insert is fitted in the second insert hole with the second platform opposed to the blank so as to define a second processing space in which the blank is to be processed. The second platform includes a second side wall. The second side wall and the second inner peripheral wall define a second surrounding groove. The second punch is movable to and away from the second processing space. An inner peripheral length of the second inner peripheral wall in the second surrounding groove decreases as a distance from the second punch increases. The third forging die assembly is adjacent to the second forging die assembly and configured to subject the blank to third processing after the blank has undergone the second processing in the second forging die assembly. The third forging die assembly includes a third die, a cylindrical guide, a third punch, and a fourth cylindrical punch. The third die includes a third insert hole. The cylindrical guide includes a third hole. The cylindrical guide includes an annular protrusion along an opening of the third hole. The annular protrusion is inserted in the third insert hole to define a third processing space. The annular protrusion is provided on an opposed surface opposed to the blank. A height of the annular protrusion from the opposed surface is larger than at least a height of a surrounding wall of the blank. The third punch is fitted in the third hole and includes a rod-shaped shank, a rod-shaped distal end closer to the blank than the rod-shaped shank, and an inclined frustum portion between the rod-shaped shank and the rod-shaped distal end. The fourth cylindrical punch is movable to and away from the third processing space. The fourth cylindrical punch is configured to clamp the blank between the third punch and the fourth cylindrical punch so as to define a through hole in the blank. The transfer mechanism is configured to transfer the blank between adjacent two forging die assemblies among the first forging die assembly, the second forging die assembly, and the third forging die assembly. The controller is configured to control the first forging die assembly, the second forging die assembly, the third forging die assembly, and the transfer mechanism to operate. The controller is configured to clamp the blank in the first processing space between the first pin, the first cylindrical insert, and the first punch so as to press the blank forced in the first hole of the first cylindrical insert using a first end portion of the first pin to provide a pilot portion on the blank, and so as to provide the blank forced in the first surrounding groove with the surrounding wall surrounding the pilot portion. The controller is configured to clamp the blank in the second processing space between the second cylindrical insert and the second punch so as to incline the surrounding wall inserted in the second surrounding groove toward the pilot portion. The controller is configured to clamp the blank in the third processing space between the cylindrical guide, the third punch, and the fourth cylindrical punch so as to provide the through hole in the blank and incline the pilot portion toward the surrounding wall.

According to another aspect of the present invention, an apparatus to produce a self-piercing and clinch nut includes a first forging die assembly, a second forging die assembly, a third forging die assembly, and a transfer mechanism. The first forging die assembly is configured to subject a blank to first processing. The first forging die assembly includes a first die, a first cylindrical insert, a first punch, and a first pin. The first die includes a first insert hole and a first inner peripheral wall defining the first insert hole. The first cylindrical insert includes a first platform. The first cylindrical insert is fitted in the first insert hole with the first platform opposed to the blank so as to define a first processing space in which the blank is to be processed. The first platform includes a first side wall. The first side wall and the first inner peripheral wall define a first surrounding groove. The first punch is movable to and away from the first processing space. The first pin is fitted in a first hole of the first cylindrical insert. The second forging die assembly is adjacent to the first forging die assembly and configured to subject the blank to second processing after the blank has undergone the first processing in the first forging die assembly. The second forging die assembly includes a second die, a second cylindrical insert, and a second punch. The second die includes a second insert hole and a second inner peripheral wall defining the second insert hole. The second cylindrical insert includes a second platform. The second cylindrical insert is fitted in the second insert hole with the second platform opposed to the blank so as to define a second processing space in which the blank is to be processed. The second platform includes a second side wall. The second side wall and the second inner peripheral wall define a second surrounding groove. The second punch is movable to and away from the second processing space. An inner peripheral length of the second inner peripheral wall in the second surrounding groove decreases as a distance from the second punch increases. The third forging die assembly is adjacent to the second forging die assembly and configured to subject the blank to third processing after the blank has undergone the second processing in the second forging die assembly. The third forging die assembly includes a third die, a cylindrical guide, a third punch, and a fourth cylindrical punch. The third die includes a third insert hole. The cylindrical guide includes a third hole. The cylindrical guide includes an annular protrusion along an opening of the third hole. The annular protrusion is inserted in the third insert hole to define a third processing space. The annular protrusion is provided on an opposed surface opposed to the blank. A height of the annular protrusion from the opposed surface is larger than at least a height of a surrounding wall of the blank. The third punch is fitted in the third hole and includes a rod-shaped shank, a rod-shaped distal end closer to the blank than the rod-shaped shank, and an inclined frustum portion between the rod-shaped shank and the rod-shaped distal end. The fourth cylindrical punch is movable to and away from the third processing space. The fourth cylindrical punch is configured to clamp the blank between the third punch and the fourth cylindrical punch so as to define a through hole in the blank. The transfer mechanism is configured to transfer the blank between adjacent two forging die assemblies among the first forging die assembly, the second forging die assembly, and the third forging die assembly.

According to further aspect of the present invention, in a method for producing a self-piercing and clinch nut, a first forging die assembly, a second forging die assembly, and a third forging die assembly is provided. The first forging die assembly includes a first die, a first cylindrical insert, a first punch, and a first pin. The first die includes a first insert hole and a first inner peripheral wall defining the first insert hole. The first cylindrical insert includes a first platform. The first cylindrical insert is fitted in the first insert hole with the first platform opposed to a blank so as to define a first processing space in which the blank is to be processed. The first platform includes a first side wall. The first side wall and the first inner peripheral wall define a first surrounding groove. The first punch is movable to and away from the first processing space. The first pin is fitted in a first hole of the first cylindrical insert. The second forging die assembly includes a second die, a second cylindrical insert, and a second punch. The second die includes a second insert hole and a second inner peripheral wall defining the second insert hole. The second cylindrical insert includes a second platform. The second cylindrical insert is fitted in the second insert hole with the second platform opposed to the blank so as to define a second processing space in which the blank is to be processed. The second platform includes a second side wall. The second side wall and the second inner peripheral wall define a second surrounding groove. The second punch is movable to and away from the second processing space. An inner peripheral length of the second inner peripheral wall in the second surrounding groove decreases as a distance from the second punch increases. The third forging die assembly includes a third die, a cylindrical guide, a third punch, and a fourth cylindrical punch. The third die includes a third insert hole. The cylindrical guide includes a third hole. The cylindrical guide includes an annular protrusion along an opening of the third hole. The annular protrusion is inserted in the third insert hole to define a third processing space. The annular protrusion is provided on an opposed surface opposed to the blank. A height of the annular protrusion from the opposed surface is larger than at least a height of a surrounding wall of the blank. The third punch is fitted in the third hole and includes a rod-shaped shank, a rod-shaped distal end closer to the blank than the rod-shaped shank, and an inclined frustum portion between the rod-shaped shank and the rod-shaped distal end. The fourth cylindrical punch is movable to and away from the third processing space. The fourth cylindrical punch is configured to clamp the blank between the third punch and the fourth cylindrical punch so as to define a through hole in the blank. The blank is provided in the first processing space. After the blank has been provided in the first processing space, the blank is clamped between the first pin, the first cylindrical insert, and the first punch so as to press the blank forced in the first hole of the first cylindrical insert using a first end portion of the first pin to provide a pilot portion on the blank and to provide the blank forced in the first surrounding groove with the surrounding wall surrounding the pilot portion. After the blank has been clamped between the first pin, the first cylindrical insert, and the first punch, the blank is provided in the second processing space. After the blank has been provided in the second processing space, the blank is clamped between the second cylindrical insert and the second punch so as to incline the surrounding wall inserted in the second surrounding groove toward the pilot portion. After the blank has been clamped between the second cylindrical insert and the second punch, the blank is provided in the third processing space. After the blank has been provided in the third processing space, the blank is clamped between the cylindrical guide, the third punch, and the fourth cylindrical punch so as to provide the through hole and to incline the pilot portion toward the surrounding wall.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 18 is a plan view of an exemplary configuration of a second insert;

DESCRIPTION OF THE EMBODIMENTS

Figure 1:
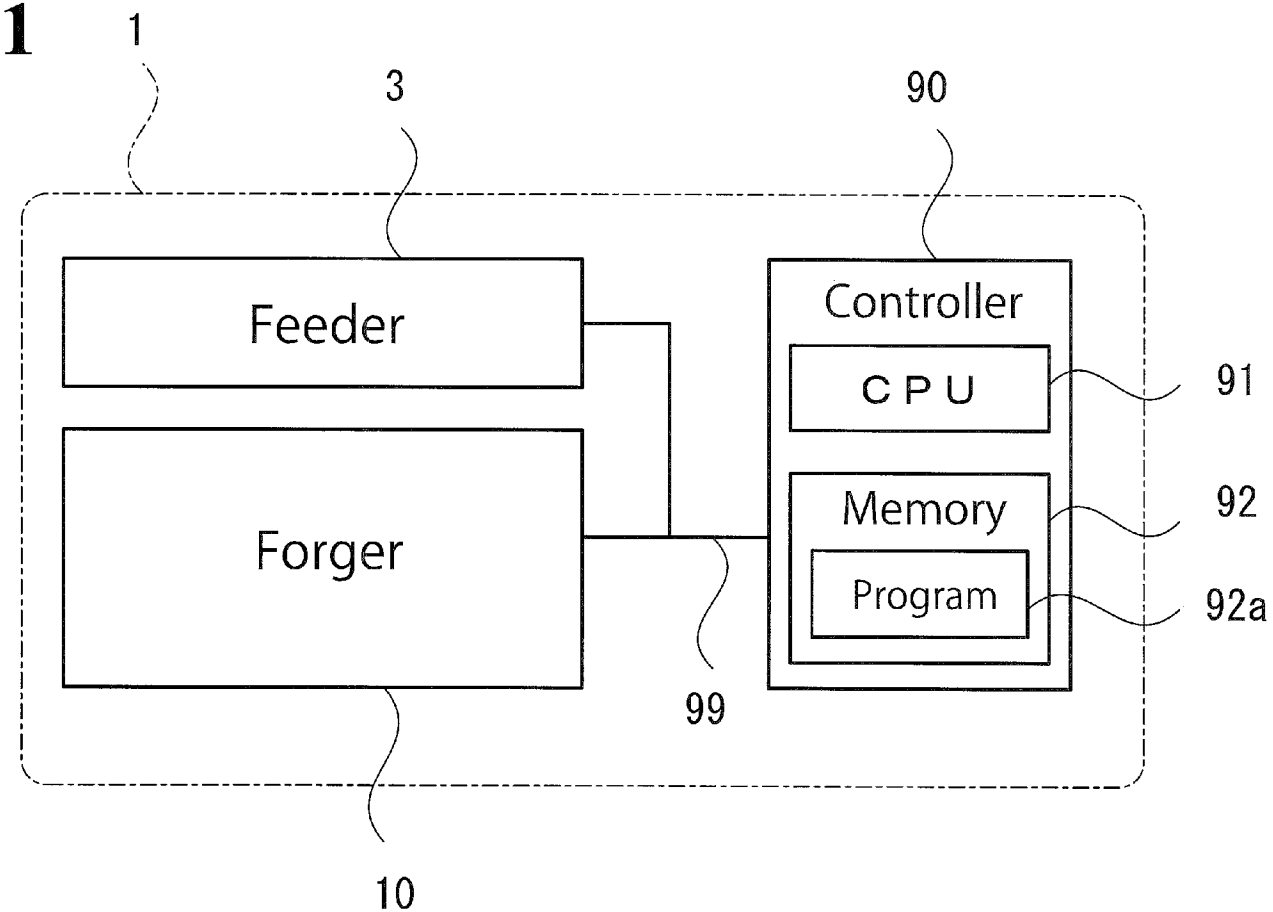
FIG. 1 is a block diagram illustrating an exemplary general arrangement of a production apparatus according to an embodiment.

The embodiments will now be described with reference to the accompanying drawings, wherein like reference numerals designate corresponding or identical elements throughout the various drawings.

1. General Arrangement of the Production Apparatus

FIG. 1 is a block diagram illustrating an exemplary configuration of an apparatus 1 to produce a self-piercing and clinch nut (hereinafter referred to simply as "production apparatus") according to an embodiment. As shown in FIG. 1, the production apparatus 1 mainly includes a feeder 3, a forger 10, and a controller 90. For clarity of directions, FIG. 2 and the subsequent drawings are attached, as necessary, with an XYZ Cartesian coordinate system, in which the Z axis direction is assumed as the vertical direction and the XY plane is assumed as the horizontal plane.

The feeder 3 feeds a material of blanks (nut blanks) to the forger 10. The material of blanks is a wire material having an approximately rectangular cross-section. The forger 10 produces blanks for self-piercing and clinch nuts, and the blanks have an approximately rectangular external shape. A detailed configuration of the forger 10 will be described later.

The controller 90 controls the feeder 3 and the forger 10 to operate. As shown in FIG. 1, the controller 90 mainly includes a CPU 91 and a memory 92. In accordance with a program 92*a* stored in the memory 92, the CPU 91 executes, at a predetermined timing, operation control of the feeder 3 and the forger 10, which are electrically connected to the controller 90 through a signal line 99.

Figure 2:
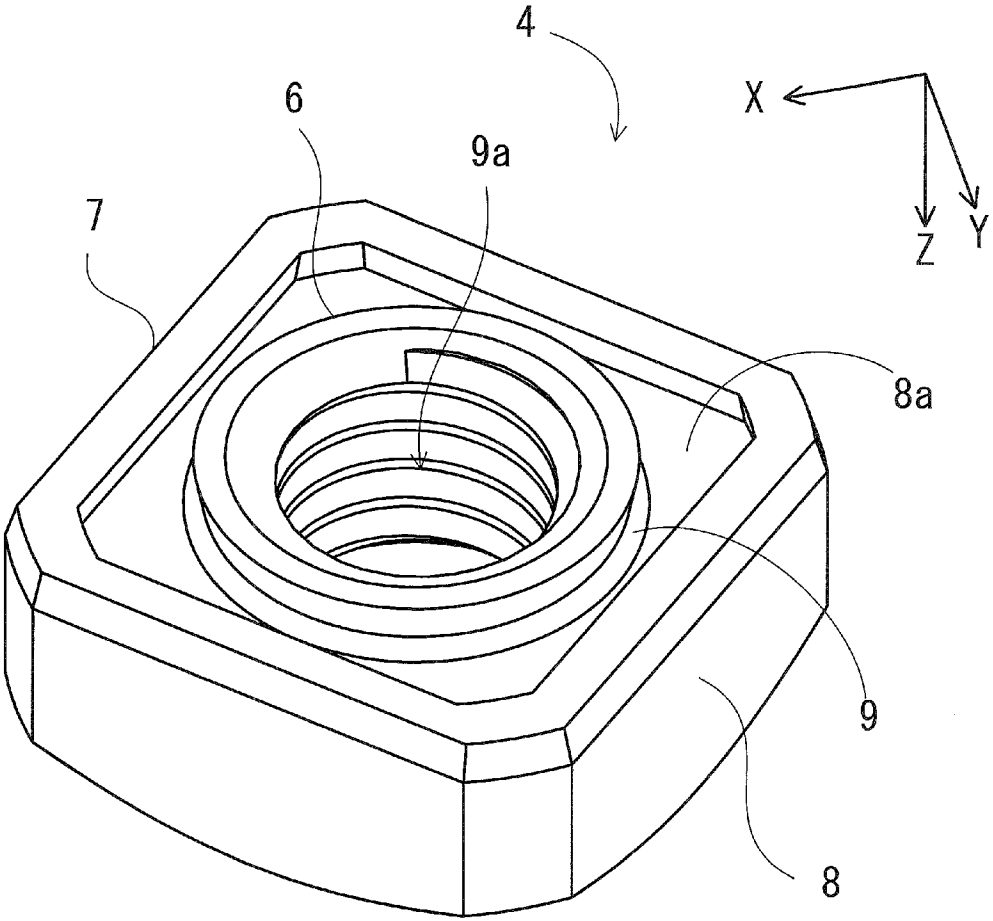
FIG. 2 is a perspective view of an exemplary configuration of a self-piercing and clinch nut produced by the production apparatus according to the embodiment.
Figure 3:
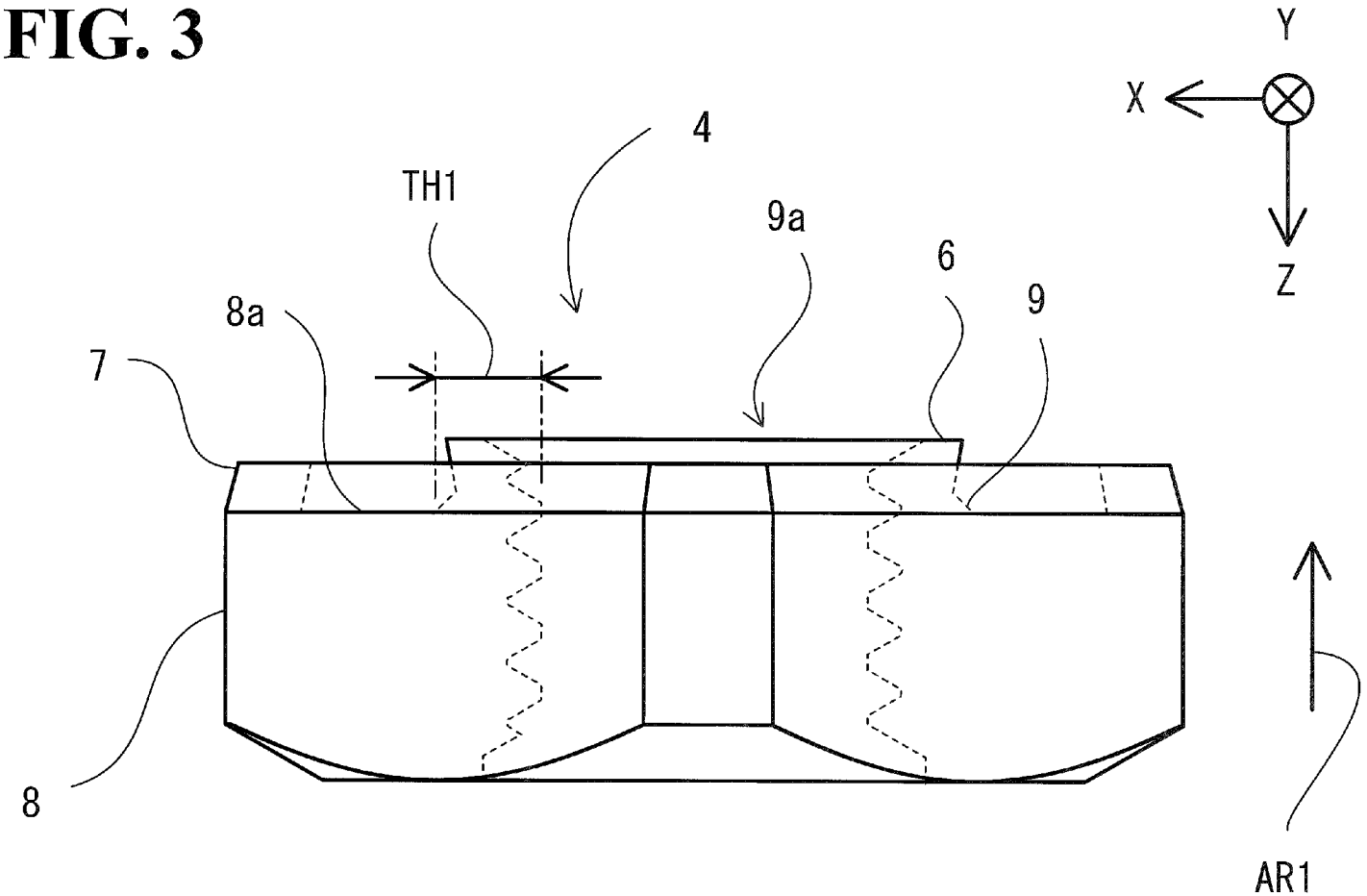
FIG. 3 is a front view of the exemplary configuration of the self-piercing and clinch nut produced by the production apparatus according to the embodiment.
Figure 4:
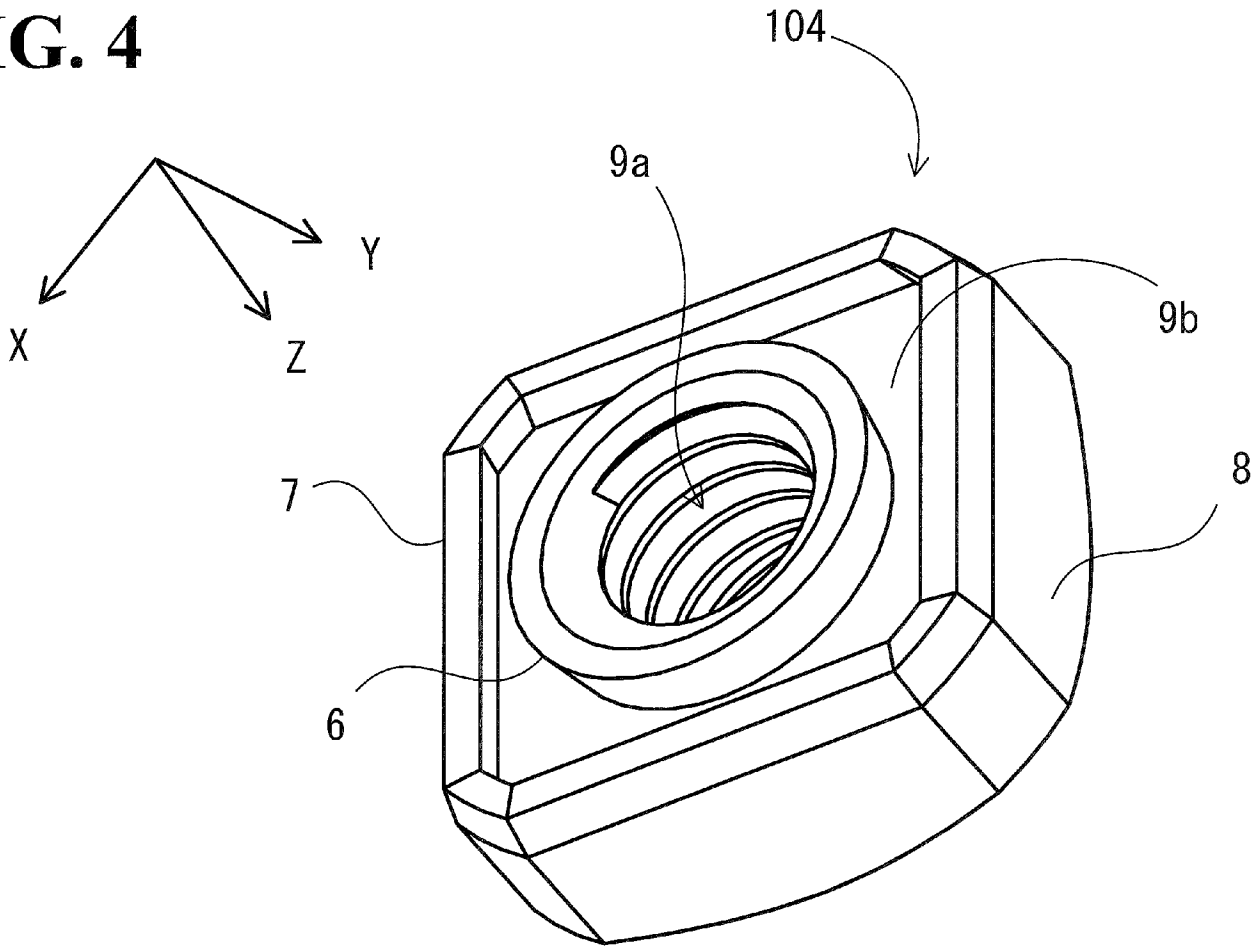
FIG. 4 is a perspective view of another exemplary configuration of a self-piercing and clinch nut.
Figure 5:
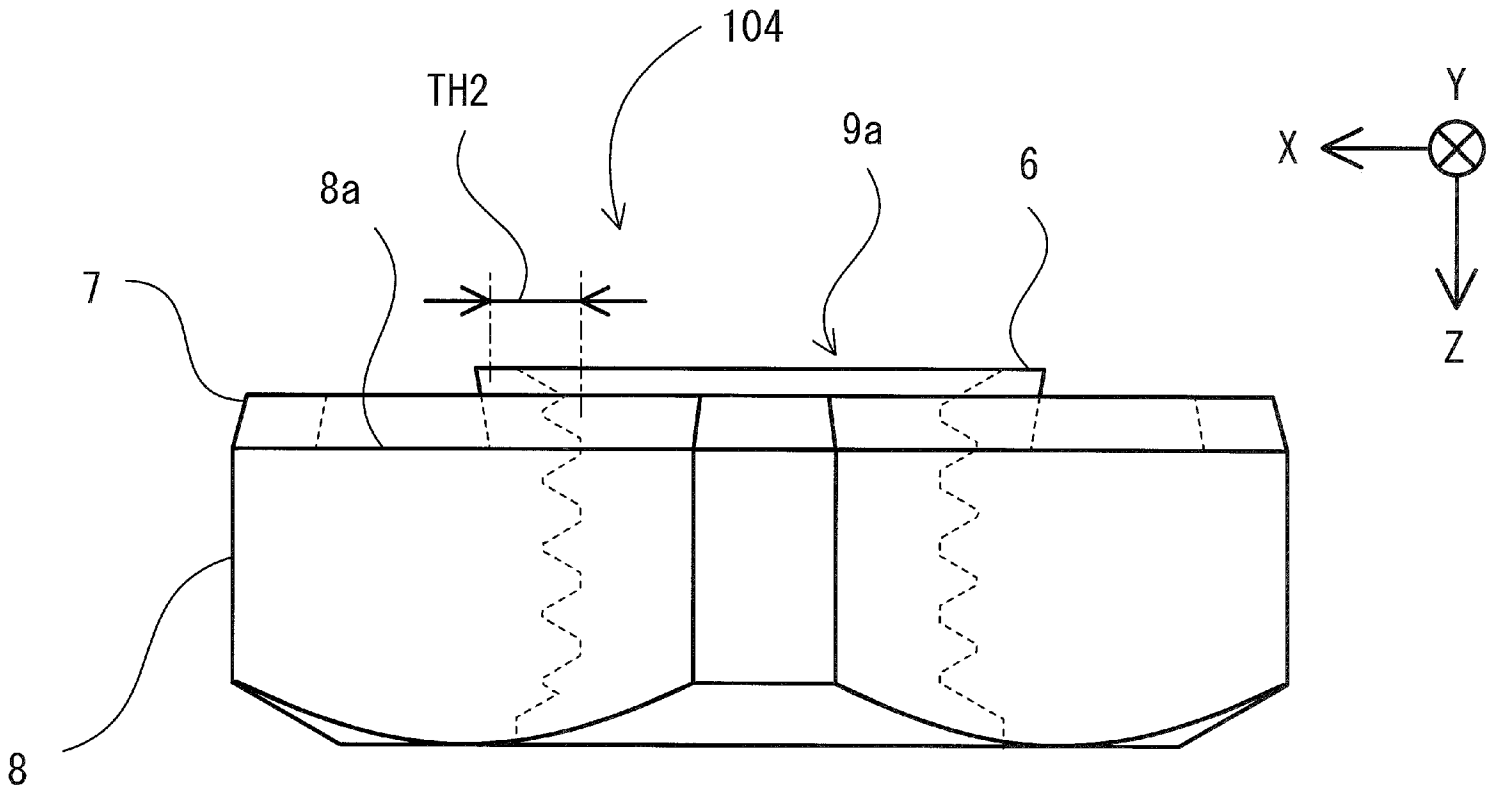
FIG. 5 is a front view of the another exemplary configuration of the self-piercing and clinch nut.

FIGS. 2 and 3 are respectively a perspective view and a front view of an exemplary configuration of a self-piercing and clinch nut 4 produced by the production apparatus 1 according to this embodiment. FIGS. 4 and 5 are respectively a perspective view and a front view of an exemplary configuration of a self-piercing and clinch nut 104, which is different from the self-piercing and clinch nut 4.

The self-piercing and clinch nut 4 is a nut to be secured on a parent material such as a steel sheet through application of pressure. As shown in FIGS. 2 and 3, the self-piercing and clinch nut 4 mainly includes a pilot portion 6, a surrounding wall (rib) 7, a main body 8, and a thick portion 9.

The main body 8 is an approximately rectangular parallelepiped having a through hole 9*a*. As shown in FIG. 3, the through hole 9*a* extends in a direction indicated by the arrow AR1 (a direction in parallel to the arrow AR1 (which is along the Z axis) will be hereinafter occasionally referred to as "extending direction"). The through hole 9*a* is a screw hole.

The thick portion 9 is a truncated cone protruding from a central portion of a flat surface 8*a* of the main body 8. As shown in FIGS. 2 and 3, the through hole 9*a* is formed in the center of the thick portion 9 in a manner similar to the main body 8.

The pilot portion 6 is a tool to punch a hole in the parent material utilizing pressure exerted in the direction indicated by the arrow AR1. As shown in FIGS. 2 and 3, the pilot portion 6 has a truncated-cone external shape protruding from the upper surface of the thick portion 9 in an outward direction from the main body 8. The through hole 9*a* is formed in the center of the pilot portion 6 in a manner similar to the main body 8 and the thick portion 9.

The surrounding wall 7 has a cylindrical shape along the outer periphery of the flat surface 8*a*. There is a gap between the pilot portion 6 and the surrounding wall 7, and part of the punched parent material is deformed to fill the gap. In this manner, the self-piercing and clinch nut 4 is secured on the parent material. As shown in FIG. 3, the outer peripheral length and the inner peripheral length of the surrounding wall 7 in a direction perpendicular to the extending direction of the through hole 9*a* decrease gradually as the distance from the flat surface 8*a* increases.

Also, as shown in FIG. 3, the thick portion 9 has an outer peripheral length in the direction perpendicular to the extending direction of the through hole 9*a*. The outer peripheral length of the thick portion 9 decreases gradually as the distance from the flat surface 8*a* increases. The pilot portion 6 has an outer peripheral length in the direction perpendicular to the extending direction of the through hole 9*a*. The outer peripheral length of the pilot portion 6 increases gradually as the distance from the flat surface 8*a* increases.

The self-piercing and clinch nut 4 produced by the production apparatus 1 according to this embodiment will be compared with the self-piercing and clinch nut 104, which has no thick portion 9 (see FIGS. 4 and 5). The comparison shows that a thickness TH1 of the thick portion 9 on the outer periphery of the through hole 9*a* in the self-piercing and clinch nut 4 (see FIG. 3) can be set at a thickness larger than a thickness TH2 of a pilot portion 6 on the outer periphery of a through hole 9*a* in the self-piercing and clinch nut 104 (see FIG. 5).

Thus, the self-piercing and clinch nut 4 produced by the production apparatus 1 according to this embodiment prevents the pilot portion 6 and the thick portion 9 from buckling, which may occur due to compressive stress of the pilot portion 6 and the thick portion 9 at the time of punching of the parent material.

As described above, the self-piercing and clinch nut 4 produced by the production apparatus 1 according to this embodiment ensures sufficient amount of the thickness TH1 of the thick portion 9 on the outer periphery of the through hole 9*a* adjacent to the flat surface 8*a* (see FIG. 3). This prevents the diameter of the through hole 9*a* of the self-piercing and clinch nut 4 from changing (decreasing, for example) when the parent material is deformed to fill the gap between the pilot portion 6 and the surrounding wall 7 to clinch the parent material by the self-piercing and clinch nut 4. Thus, the use of the self-piercing and clinch nut 4 produced by the production apparatus 1 according to this embodiment eliminates or minimizes such an occurrence that the self-piercing and clinch nut 4 cannot receive a screw after the self-piercing and clinch nut 4 has been secured on the parent material.

2. Configuration of the Forger

Figure 6:
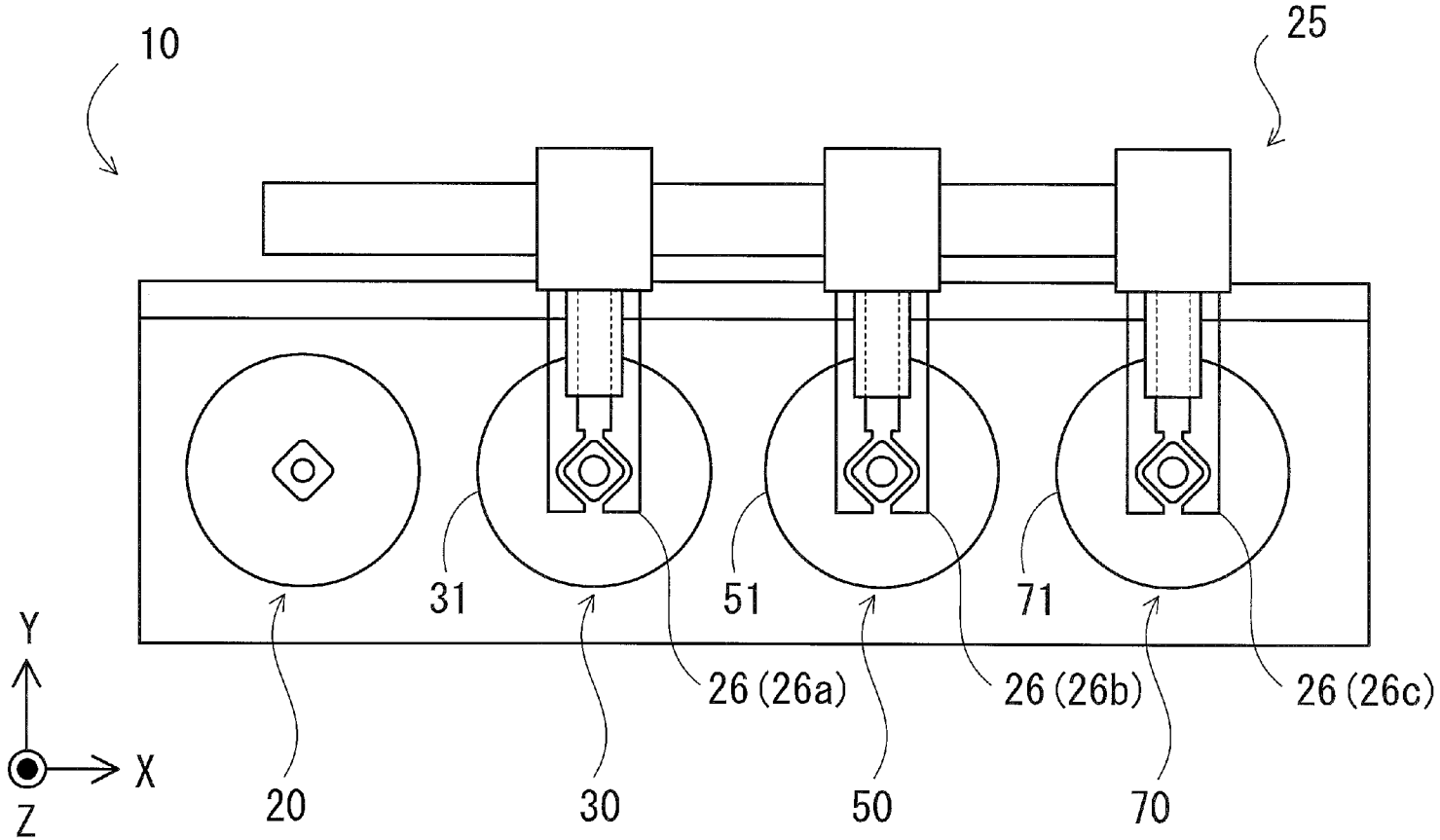
FIG. 6 is a plan view of an exemplary configuration of a forger according to the embodiment.
Figure 7:
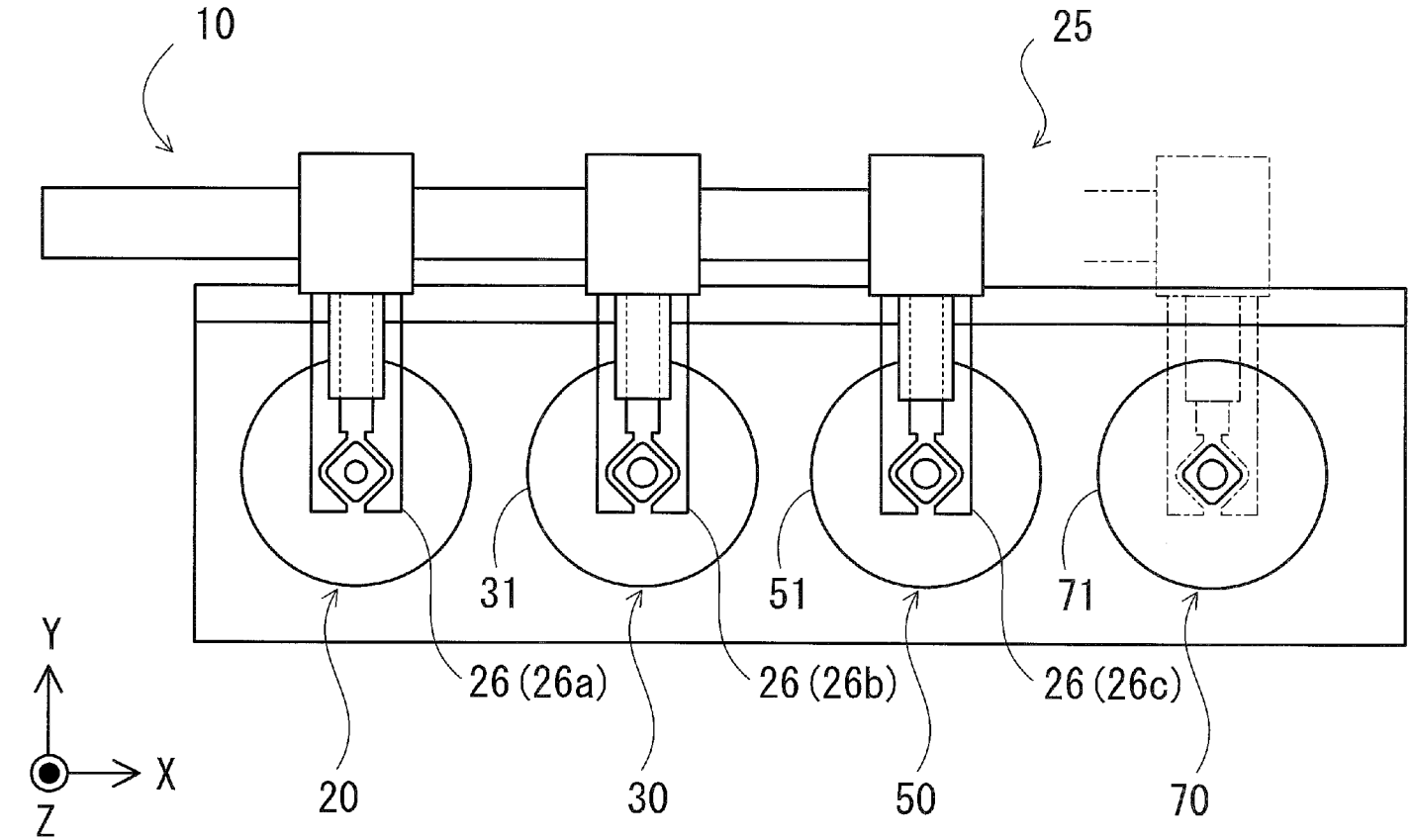
FIG. 7 is a plan view of the exemplary configuration of the forger according to the embodiment.

FIGS. 6 and 7 are plan views illustrating an exemplary configuration of the forger 10 according to this embodiment. The forger 10 cuts the wire material fed from the feeder 3 into pieces of a desired size. Then, the forger 10 subjects the cut pieces of the wire material to a plurality of forging steps to produce blanks in forms before undergoing tapping (internal threading). As shown in FIGS. 6 and 7, the forger 10 mainly includes a preliminary forging die assembly 20, a transfer mechanism 25, a first forging die assembly 30, a second forging die assembly 50, and a third forging die assembly 70.

The preliminary forging die assembly 20 subjects the cut pieces of the wire material fed from the feeder 3 to desired preliminary forging. As shown in FIGS. 6 and 7, the first forging die assembly 30 is disposed adjacent to the preliminary forging die assembly 20. After the blanks have been processed in the preliminary forging die assembly 20, the first forging die assembly 30 subjects each blank to processing for preliminary forming of the pilot portion 6 and the surrounding wall 7 (first processing).

The second forging die assembly 50 is disposed adjacent to the first forging die assembly 30. After the blanks have undergone the first processing in the first forging die assembly 30, the second forging die assembly 50 subjects each blank to processing for inclining the pilot portion 6 toward the surrounding wall 7 (second processing).

The third forging die assembly 70 is disposed adjacent to the second forging die assembly 50. After the blanks have undergone the second processing in the second forging die assembly 50, the third forging die assembly 70 subjects each blank to processing for inclining the surrounding wall 7 toward the pilot portion 6 and for forming the through hole 9*a* in the pilot portion 6 (third processing).

The transfer mechanism 25 includes a plurality of (three in this embodiment) grippers 26 (26*a* to 26*c*). The transfer mechanism 25 transfers the blank between adjacent two forging die assemblies among the preliminary forging die assembly 20, the first forging die assembly 30, the second forging die assembly 50, and the third forging die assembly 70. Specifically, as shown in FIGS. 6 and 7, the gripper 26*a* of the transfer mechanism 25 transfers the blank between the preliminary forging die assembly 20 and the first forging die assembly 30. The gripper 26*b* of the transfer mechanism 25 transfers the blank between the first and second forging die assemblies 30 and 50. The gripper 26*c* of the transfer mechanism 25 transfers the blank between the second and third forging die assemblies 50 and 70.

3. Configuration of the First Forging Die Assembly

Figure 8:
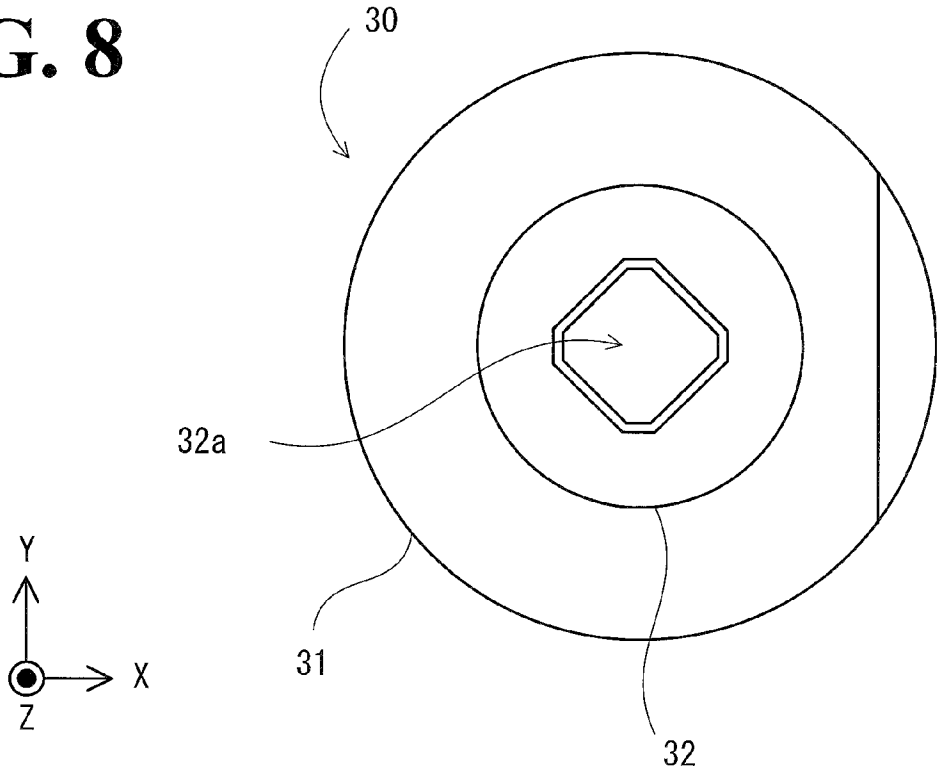
FIG. 8 is a plan view of an exemplary configuration of a first forging die assembly.
Figure 9:
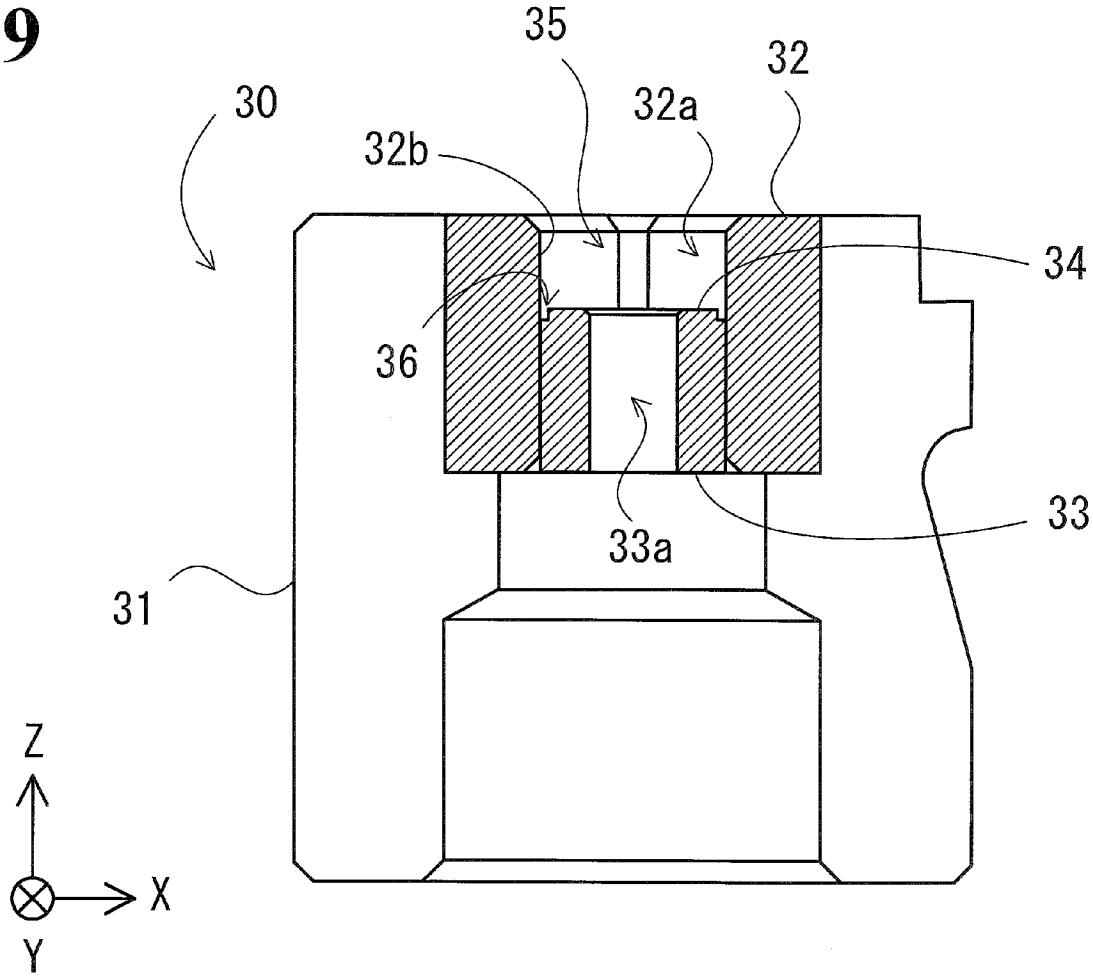
FIG. 9 is a front cross-sectional view of the exemplary configuration of the first forging die assembly.
Figure 10:
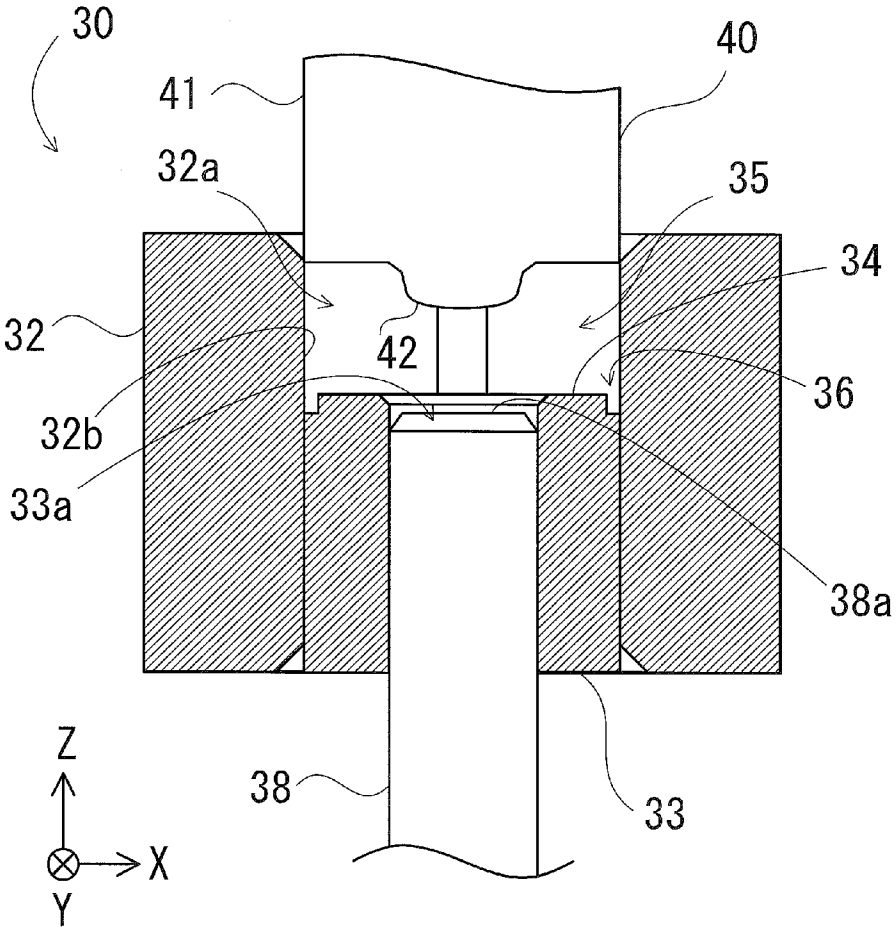
FIG. 10 is a front cross-sectional view of the exemplary configuration of the first forging die assembly.
Figure 11:
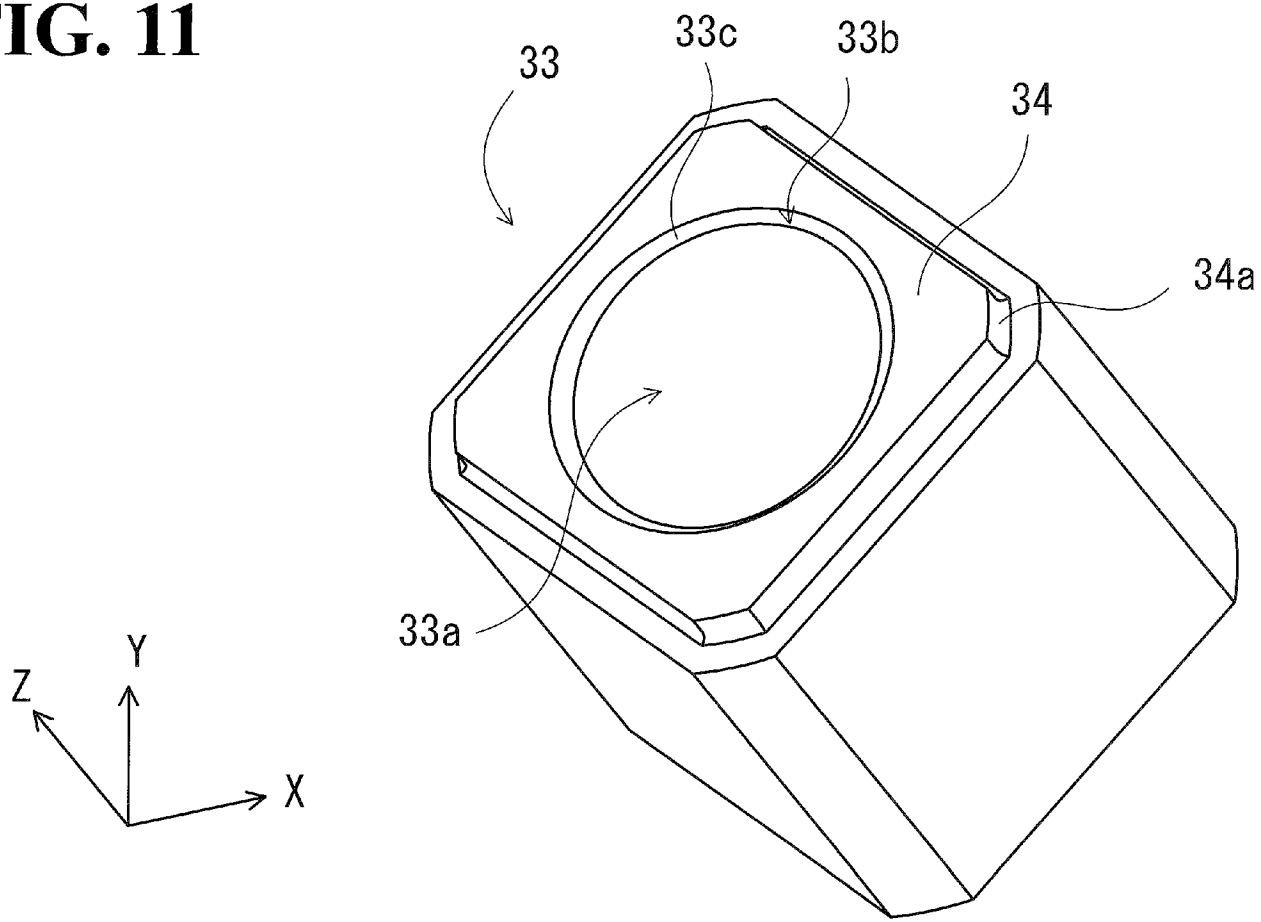
FIG. 11 is a perspective view of an exemplary configuration of a first insert.
Figure 12:
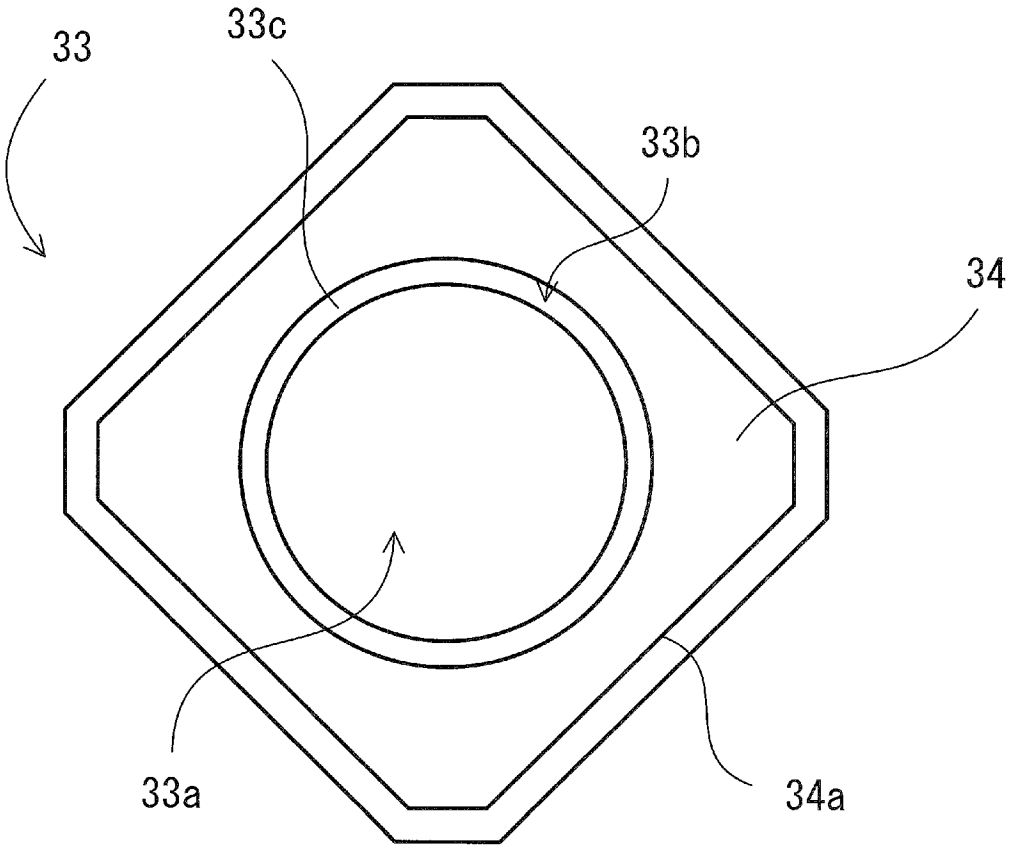
FIG. 12 is a plan view of the exemplary configuration of the first insert.
Figure 12:
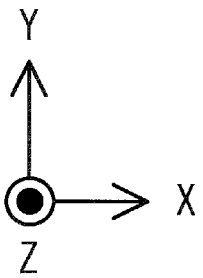
Figure 13:
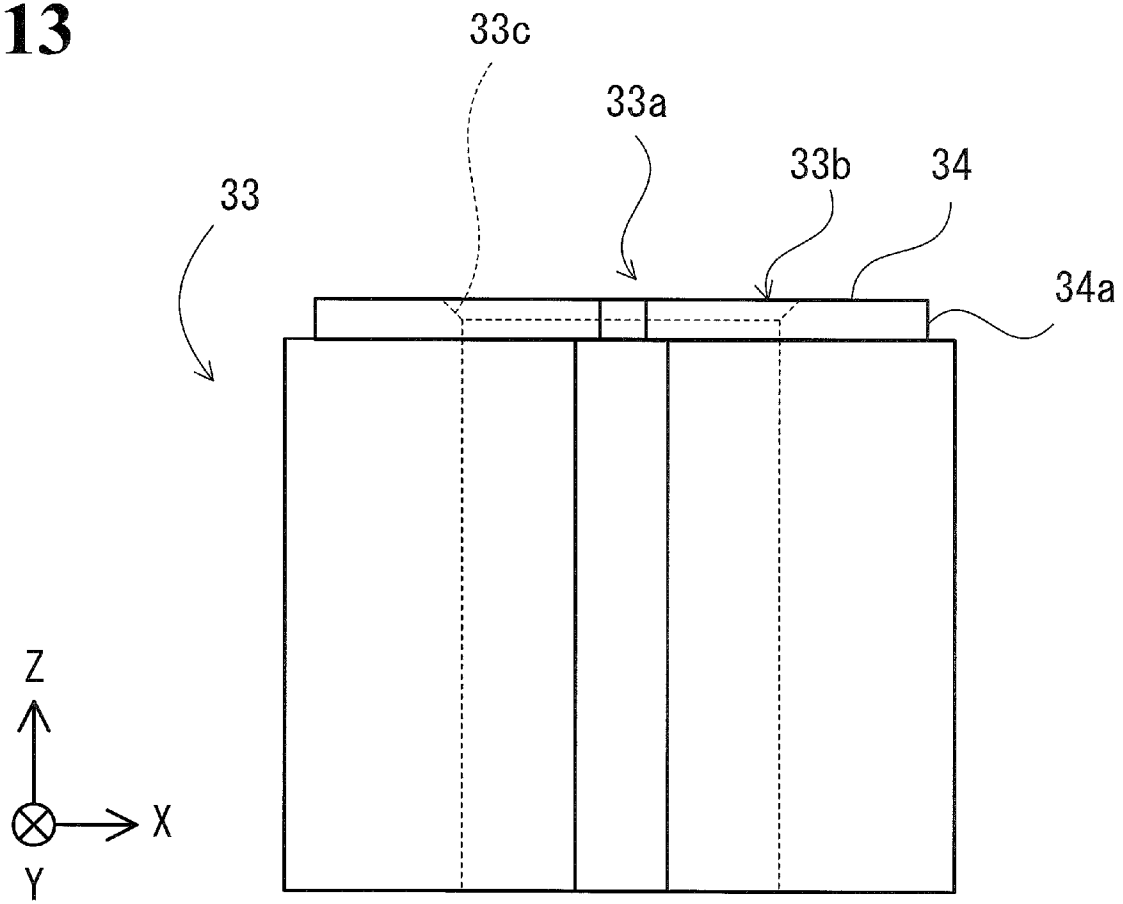
FIG. 13 is a front view of the exemplary configuration of the first insert.
Figure 14:
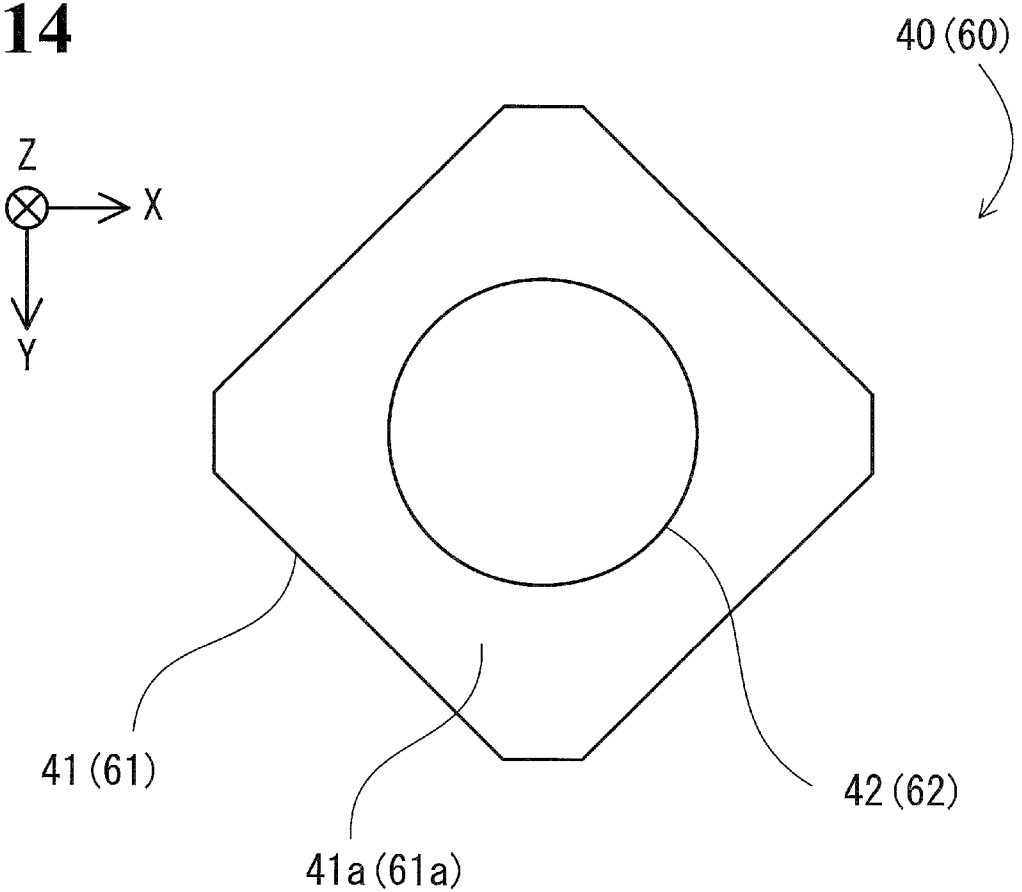
FIG. 14 is a rear view of an exemplary configuration of a first punch.

FIG. 8 is a plan view of an exemplary configuration of the first forging die assembly 30. FIGS. 9 and 10 are front cross-sectional views illustrating the exemplary configuration of the first forging die assembly 30. FIGS. 11 to 13 are respectively a perspective view, a plan view, and a front view of an exemplary configuration of a first insert 33. FIG. 14 is a rear view of an exemplary configuration of a first punch 40.

As shown in FIG. 10, the first forging die assembly 30 mainly includes a first die 32, the first insert 33, a first pin 38, and the first punch 40. These elements 32, 33, 38, 40 are accommodated in a die case 31 (see FIGS. 6 to 9).

The first die 32 is a block to receive a blank. As shown in FIGS. 9 and 10, the first die 32 has a first insert hole 32*a* extending in one direction (Z axis direction). The first insert 33 has a cylindrical shape having a first platform 34. When the blank is disposed in the first insert hole 32*a*, the first insert 33 is fitted in the first insert hole 32*a* with the first platform 34 opposed to the blank.

As shown in FIGS. 11 to 13, the first insert 33 has a first hole 33*a*. One of the two ends of the first hole 33*a* on the first platform 34 side has a first opening 33*b*. A portion of the first insert 33 adjacent to the first opening 33*b* is chamfered flatly to form a first chamfer 33*c*. The inner peripheral length of the first chamfer 33*c* (more specifically, the inner peripheral length of the first chamfer 33*c* in a direction perpendicular to the extending direction of the first hole 33*a*) increases gradually as the distance to the first opening 33*b* decreases.

Thus, a first processing space 35 in which the blank is processed is defined in the first insert hole 32*a*. Also, a first surrounding groove 36 (see FIGS. 9 and 10) is defined by a first inner peripheral wall 32*b* (see FIGS. 9 and 10), which defines the first insert hole 32*a*, and a first side wall 34*a* (see FIGS. 12 and 13) of the first platform 34.

The first punch 40 is disposed above the first insert 33 and the first pin 38, and is movable to and away from the first processing space 35. As shown in FIG. 14, the first punch 40 mainly includes a shank 41 and a distal end 42.

The shank 41 is a rod-shaped member extending in the Z axis direction. The shank 41 has an approximately rectangular cross-section in a direction perpendicular to the axial direction. The distal end 42 is a protrusion from an end portion 41*a* of the shank 41. The distal end 42 presses an upper portion of the blank adjacent to its axis to effect preliminary forming of the through hole 9*a* of the self-piercing and clinch nut 4.

The first pin 38 is a rod-shaped member fitted in the first hole 33*a* of the first insert 33, and is movable to and away from the first processing space 35. This ensures that when the first pin 38 moves upward, the blank is discharged from the first processing space 35. Adjacent to a first end portion 38*a* of the first pin 38, the cross-sectional area of the first pin 38 in the direction perpendicular to the axial direction decreases gradually as the distance to the first punch 40 decreases.

4. Configuration of the Second Forging Die Assembly

Figure 15:
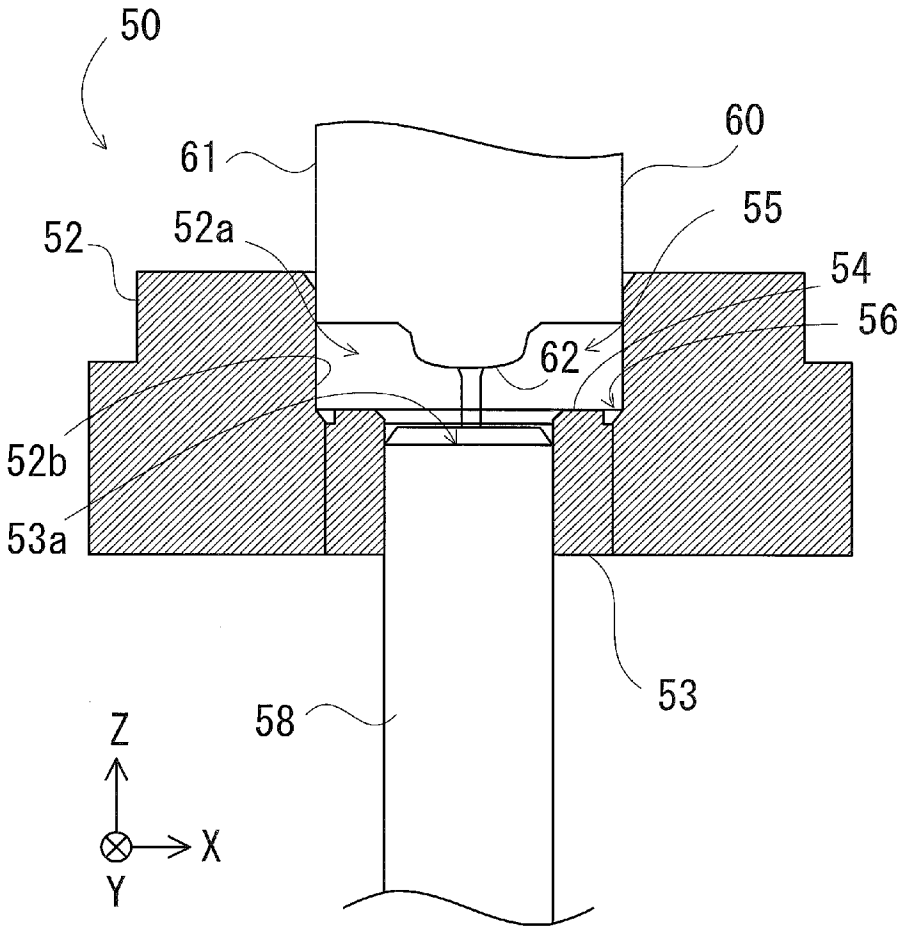
FIG. 15 is a front cross-sectional view of an exemplary configuration of a second forging die assembly.
Figure 16:
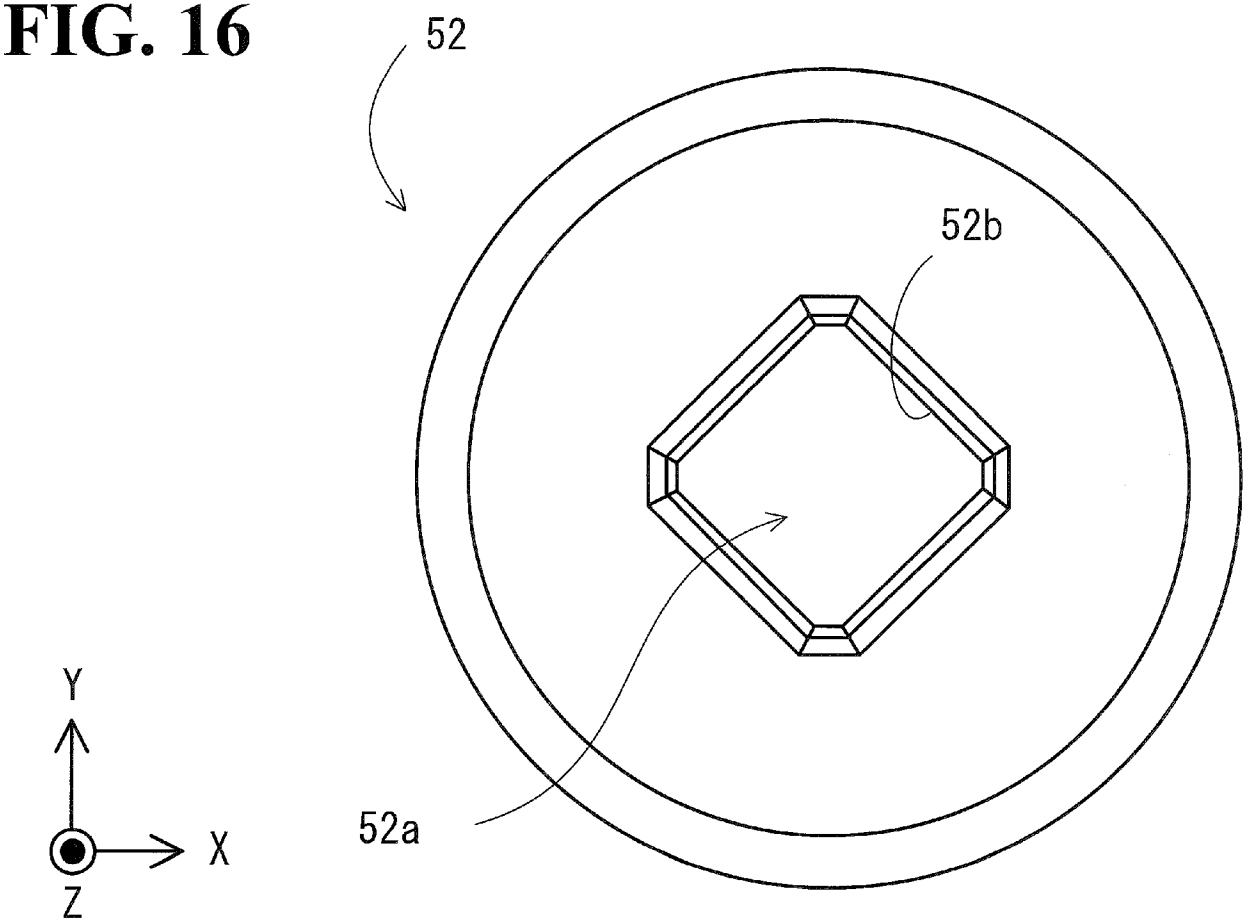
FIG. 16 is a plan view of an exemplary configuration of a second die.
Figure 17:
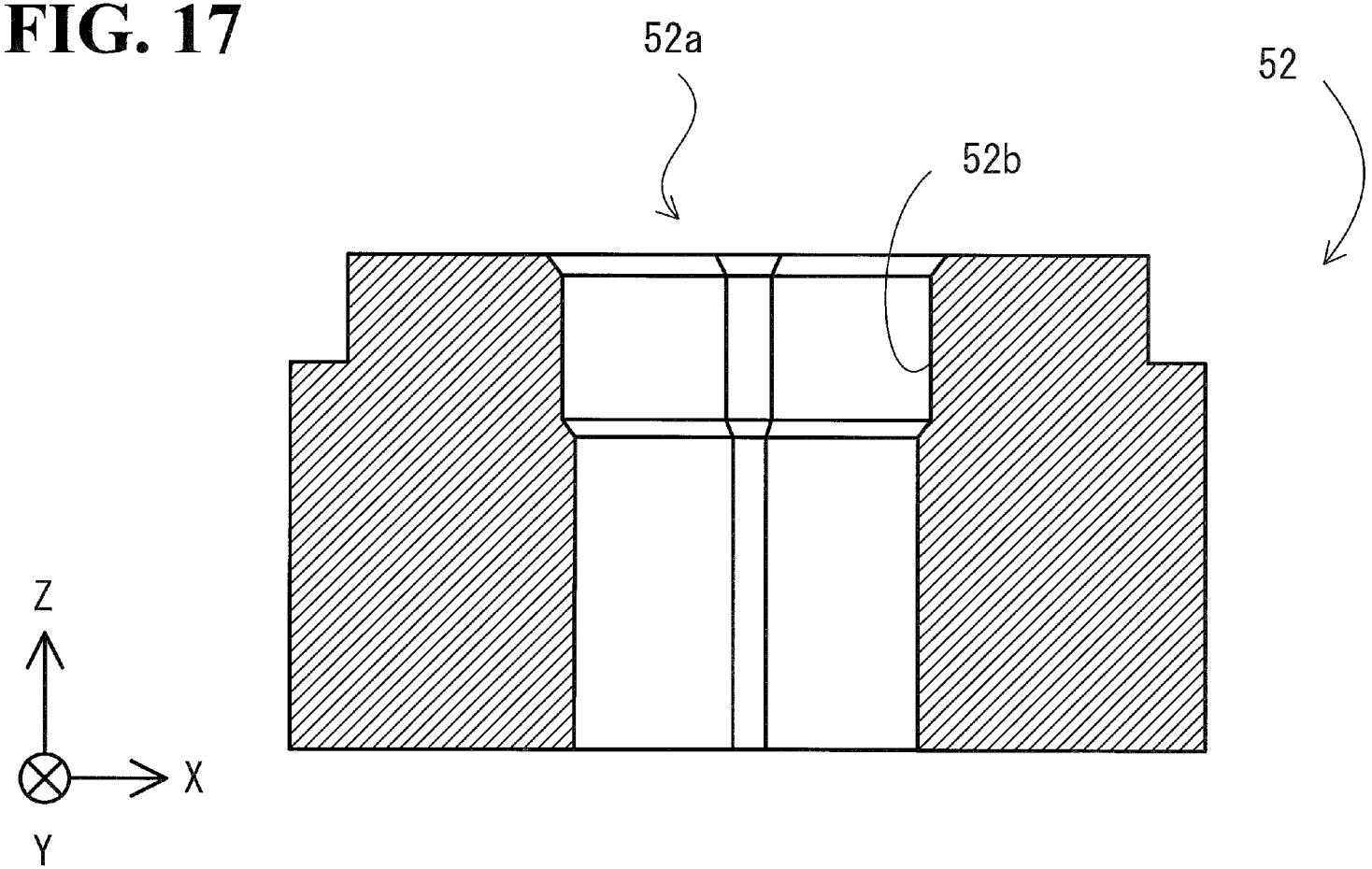
FIG. 17 is a front cross-sectional view of the exemplary configuration of the second die.
Figure 19:
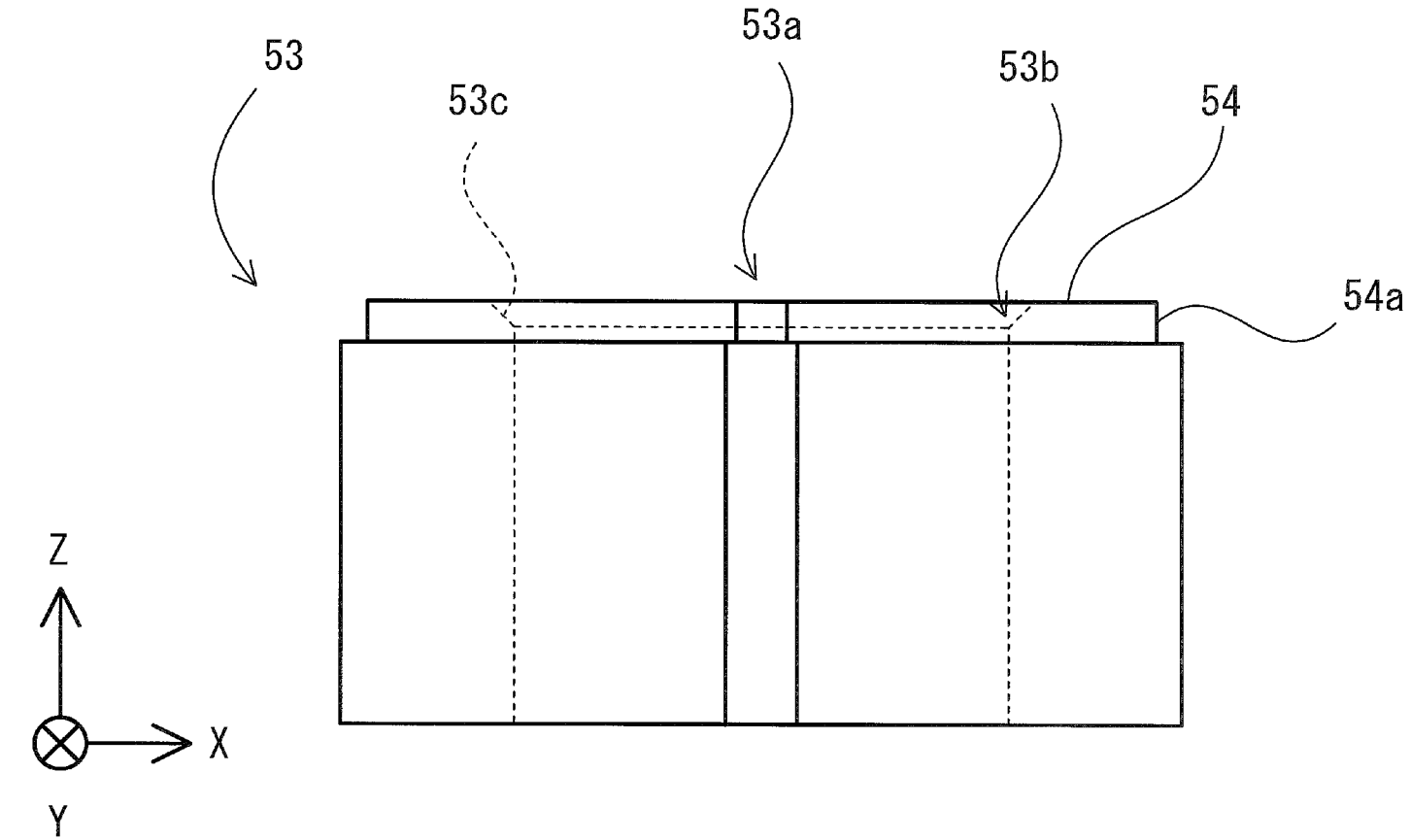
FIG. 19 is a front view of the exemplary configuration of the second insert.

FIG. 15 is a front cross-sectional view of an exemplary configuration of the second forging die assembly 50. FIGS. 16 and 17 are respectively a plan view and a front cross-sectional view of an exemplary configuration of a second die 52. FIGS. 18 and 19 are respectively a plan view and a front view of an exemplary configuration of a second insert 53.

As shown in FIG. 15, the second forging die assembly 50 mainly includes the second die 52, the second insert 53, a second pin 58, and a second punch 60. These elements 52, 53, 58, 60 are accommodated in a die case 51 (see FIGS. 6 and 7).

Similarly to the first die 32, the second die 52 is a block to receive the blank. As shown in FIG. 17, the second die 52 has a second insert hole 52*a* extending in one direction (Z axis direction). As shown in FIGS. 18 and 19, the second insert 53 is a cylindrical member having a second platform 54. When the blank is disposed in the second insert hole 52*a*, the second insert 53 is fitted in the second insert hole 52*a* with the second platform 54 opposed to the blank.

As shown in FIGS. 18 and 19, the second insert 53 has a second hole 53*a*. One of the two ends of the second hole 53*a* on the second platform 54 side has a second opening 53*b*. A portion of the second insert 53 adjacent to the second opening 53*b* is chamfered flatly to form a second chamfer 53*c*. The inner peripheral length of the second chamfer 53*c* (more specifically, the inner peripheral length of the second chamfer 53*c* in a direction perpendicular to an extending direction of the second hole 53*a*) increases gradually as the distance to the second opening 53*b* decreases.

Thus, a second processing space 55 in which the blank is processed is defined in the second insert hole 52*a*. A second surrounding groove 56 (see FIG. 15) is defined by a second inner peripheral wall 52*b* (see FIG. 15), which defines the second insert hole 52*a*, and a second side wall 54*a* (see FIGS. 18 and 19) of the second platform 54.

A second punch 60 is disposed above the second insert 53 and the second pin 58, and is movable to and away from the second processing space 55. As shown in FIG. 14, the second punch 60 has a hardware configuration similar to the first punch 40 of the first forging die assembly 30.

The second pin 58 is a rod-shaped member having a hardware configuration similar to the first pin 38 of the first forging die assembly 30. As shown in FIG. 15, the second pin 58 is fitted in the second hole 53*a* of the second insert 53, and is movable to and away from the second processing space 55. Thus, when the second pin 58 moves upward, the blank is discharged from the second processing space 55.

5. Configuration of Third Forging Die Assembly

Figure 20:
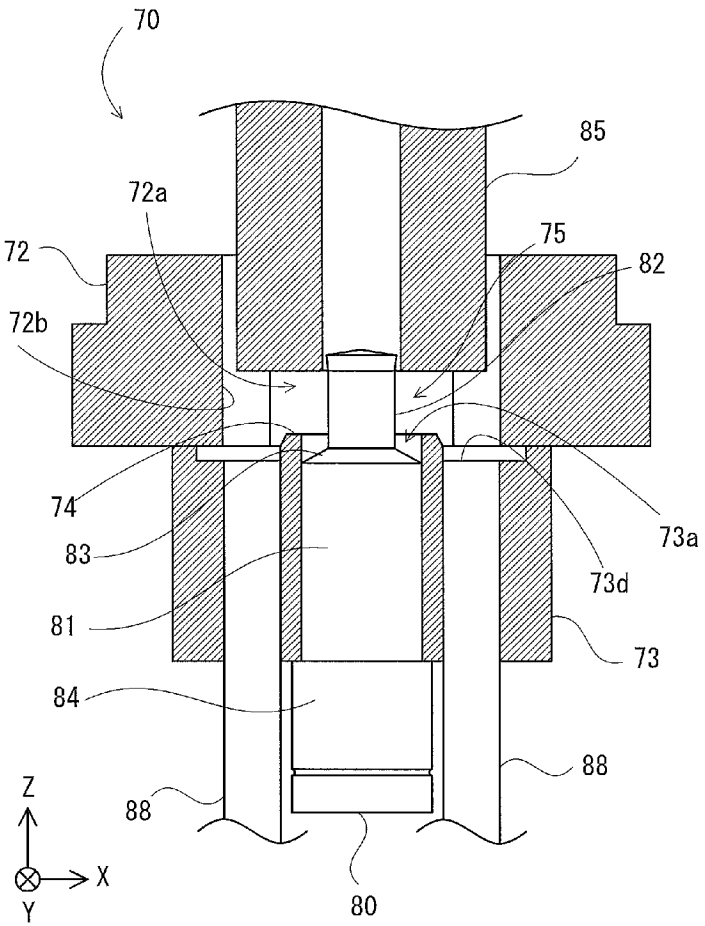
FIG. 20 is a front cross-sectional view of an exemplary configuration of a third forging die assembly.
Figure 21:
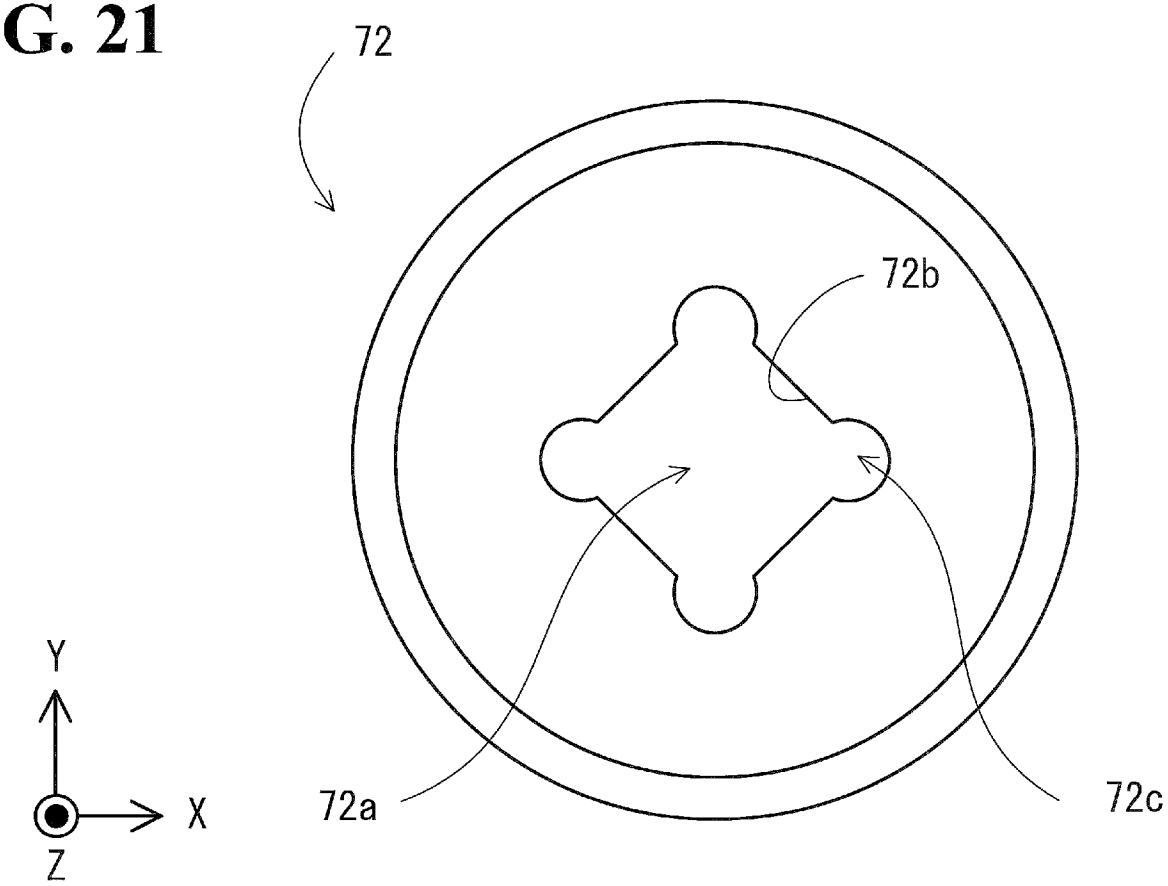
FIG. 21 is a plan view of an exemplary configuration of a third die.
Figure 22:
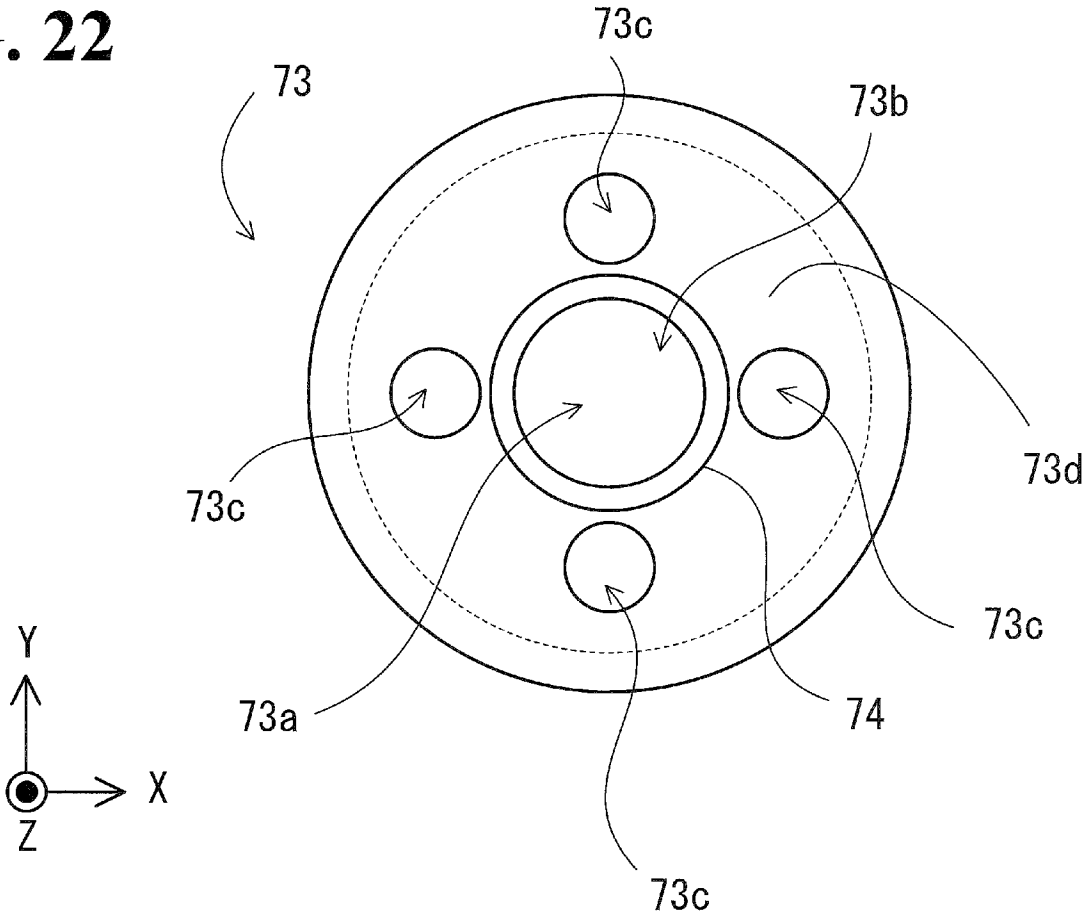
FIG. 22 is a plan view of an exemplary configuration of a guide.
Figure 23:
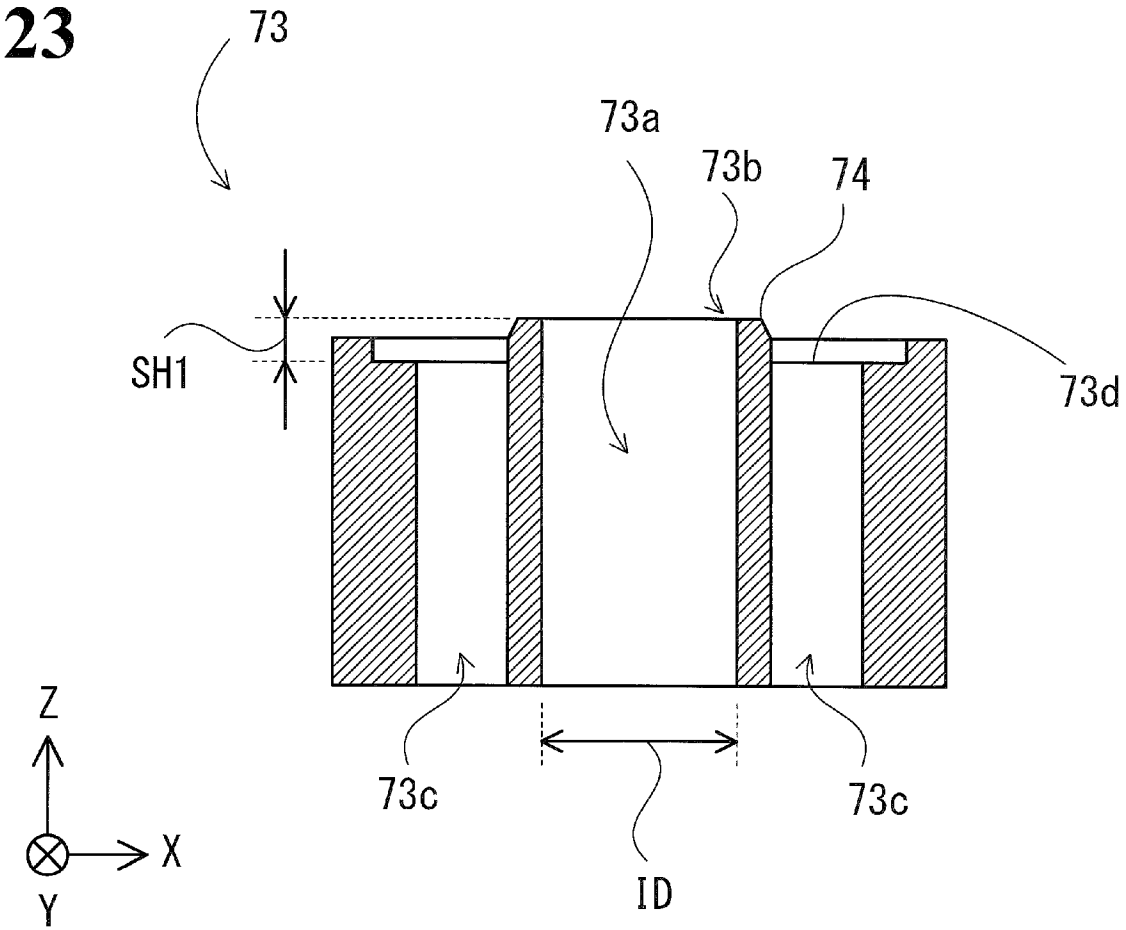
FIG. 23 is a front cross-sectional view of the exemplary configuration of the guide.
Figure 24:
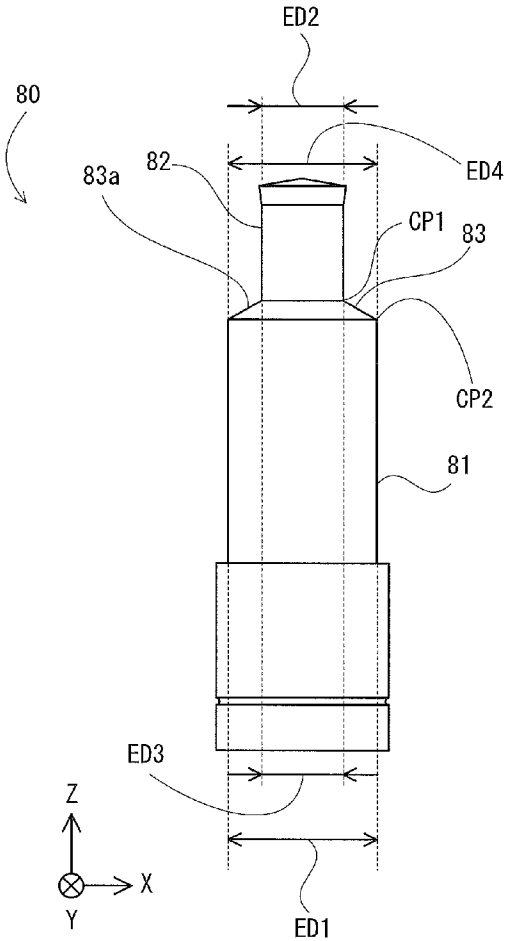
FIG. 24 is a front view of an exemplary configuration of a third punch.
Figure 25:
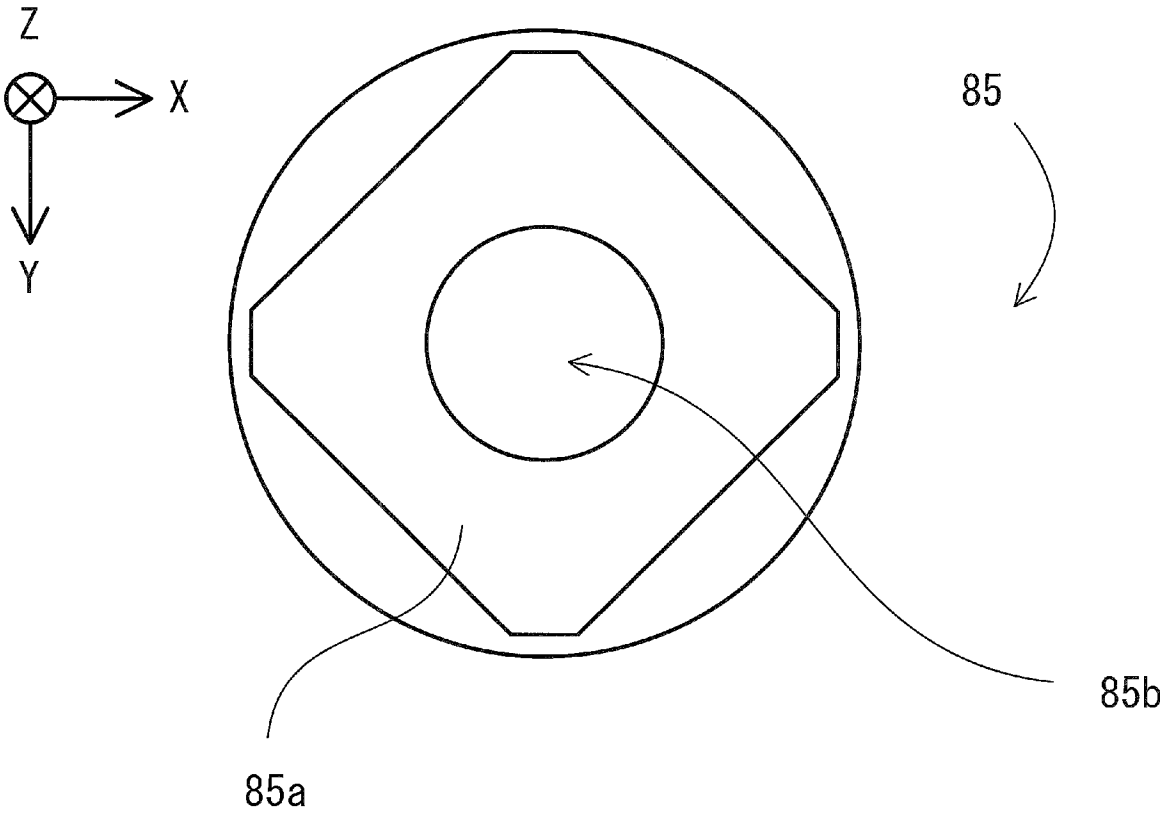
FIG. 25 is a rear view of an exemplary configuration of a fourth punch.

FIG. 20 is a front cross-sectional view of an exemplary configuration of the third forging die assembly 70. FIG. 21 is a plan view of an exemplary configuration of a third die 72. FIGS. 22 and 23 are respectively a plan view and a front cross-sectional view of an exemplary configuration of a guide 73. FIG. 24 is a front view of an exemplary configuration of a third punch 80. FIG. 25 is a rear view of an exemplary configuration of a fourth punch 85.

As shown in FIG. 20, the third forging die assembly 70 mainly includes the third die 72, the guide 73, the third punch 80, and the fourth punch 85. These elements 72, 73, 80, 85 are accommodated in a die case 71 (see FIGS. 6 and 7).

Similarly to the first and second dies 32 and 52, the third die 72 is a block to receive the blank. As shown in FIGS. 20 and 21, the third die 72 has a third insert hole 72*a* extending in one direction (Z axis direction). As shown in FIG. 21, the third insert hole 72*a* has a plurality of (four in this embodiment) notches 72*c* along a third inner peripheral wall 72*b*.

The guide 73 is a cylindrical member having a third hole 73*a*. As shown in FIGS. 22 and 23, the guide 73 includes an annular protrusion 74 along an opening 73*b* of the third hole 73*a*. As shown in FIG. 23, the annular protrusion 74 is formed on an opposed surface 73*d* opposed to the blank.

Similarly to the third insert hole 72*a*, a plurality of (four in this embodiment) guide holes 73*c* extend in one direction (Z axis direction). The guide holes 73*c* are fitted with corresponding, respective third pins 88.

When the annular protrusion 74 of the guide 73 is inserted in the third insert hole 72*a* of the third die 72 in such a manner that the guide holes 73*c* respectively communicate with the corresponding notches 72*c*, a third processing space 75 is defined in the third insert hole 72*a* (see FIG. 20).

The third punch 80 is a punching member fitted in the third insert hole 72*a*. As shown in FIG. 24, the third punch 80 mainly includes a rod-shaped shank 81, a distal end 82, and an inclined portion 83. The shank 81 and the distal end 82 are rod-shaped members, and the distal end 82 is disposed closer to the blank than the shank 81 is to the blank.

The inclined portion 83 has a frustum shape, and is disposed between the shank 81 and the distal end 82. As shown in FIG. 24, the outer diameter of the inclined portion 83 gradually increases from a first connection position CP1 to a second connection position CP2.

As shown in FIG. 20, the fourth punch 85 is a cylindrical punching member disposed above the guide 73, the third punch 80, and the plurality of third pins 88. The fourth punch 85 is movable to and away from the third processing space 75. When the blank is clamped between the third and fourth punches 80 and 85, the through hole 9*a* (see FIGS. 2 and 3) is formed in the blank.

The plurality of (four in this embodiment) third pins 88 are knockout pins to discharge the blank from the third processing space 75. As shown in FIGS. 20 to 23, the plurality of third pins 88 are movable to and away from the third processing space 75, and are disposed along the third inner peripheral wall 72*b*, which defines the third insert hole 72*a*.

Thus, when the pilot portion 6 of the blank is inclined in the third forging die assembly 70, the blank is reliably discharged from the third processing space 75. This eliminates or minimizes the production apparatus 1 stopping its operation due to discharge failure of the blank.

6. Forging Using Production Apparatus According to this Embodiment

Figure 26:
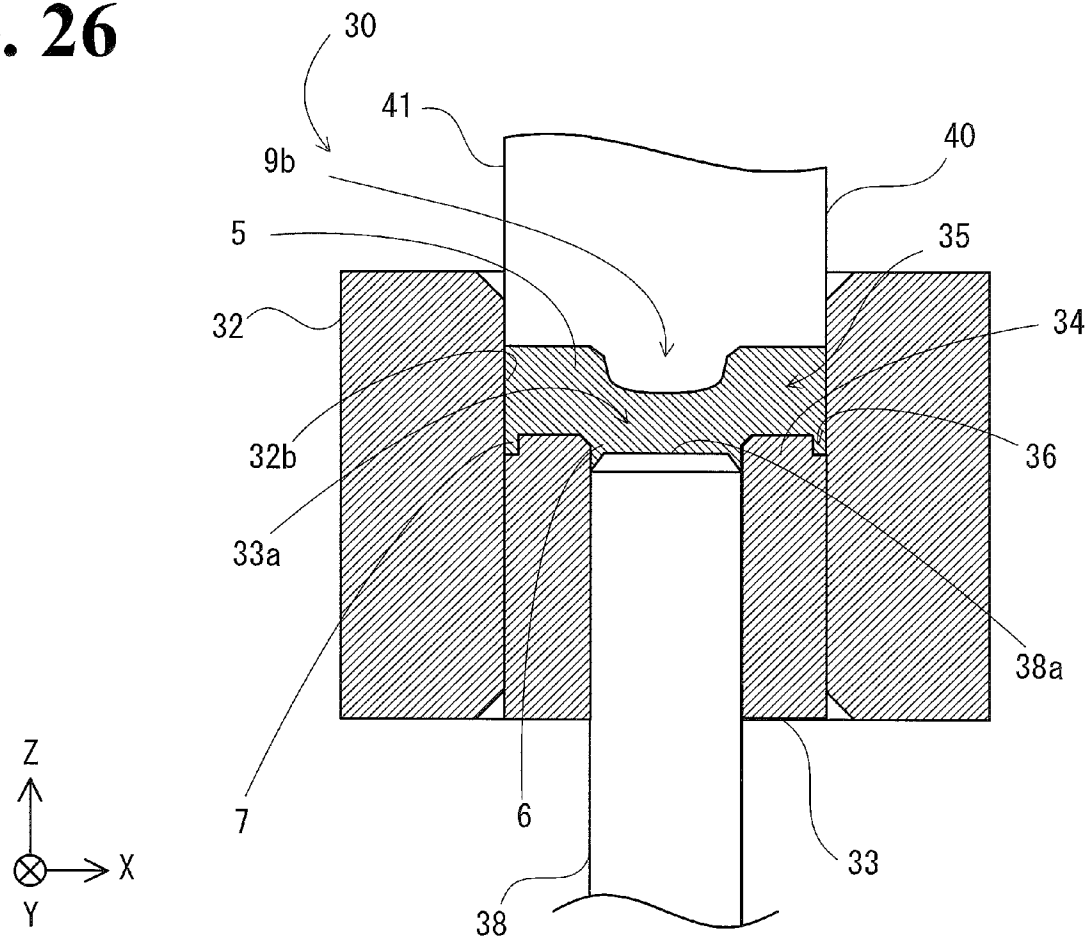
FIG. 26 is a front cross-sectional view illustrating a step of preliminarily forming a pilot portion and a surrounding wall of a blank.
Figure 27:
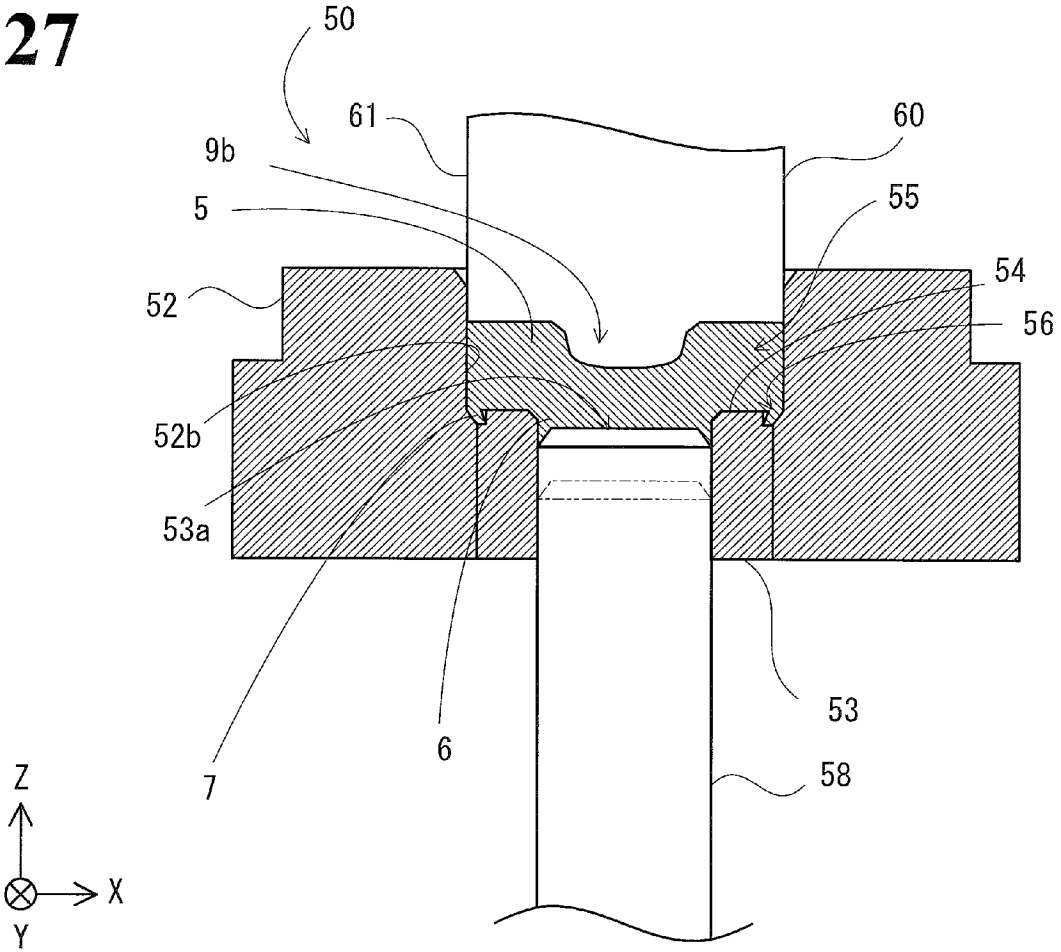
FIG. 27 is a front cross-sectional view illustrating a step of inclining the surrounding wall of the blank toward the pilot portion.
Figure 28:
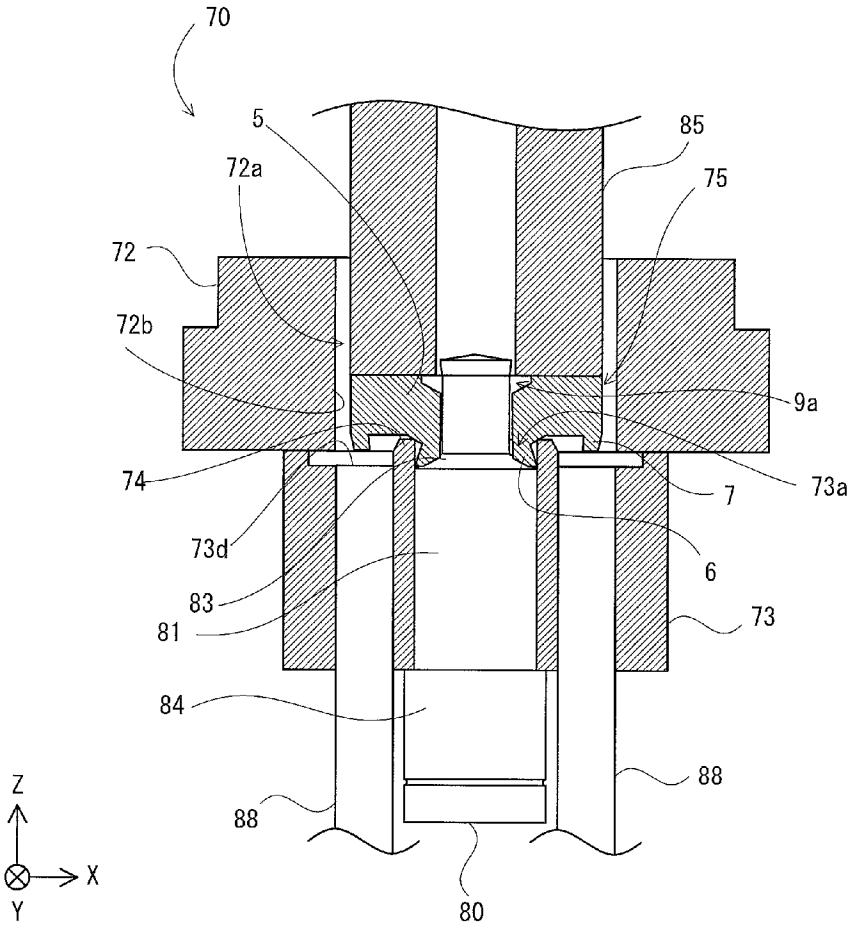
FIG. 28 is a front cross-sectional view illustrating a step of inclining the pilot portion of the blank toward the surrounding wall.

FIGS. 26 to 28 are front cross-sectional views respectively illustrating the first processing in the first forging die assembly 30, the second processing in the second forging die assembly 50, and the third processing in the third forging die assembly 70. Referring to FIGS. 26 to 28, forging of a blank performed by the production apparatus 1 will be described.

First, in the first processing, a blank 5 disposed in the first processing space 35 is clamped between the first insert 33 and the first pin 38, and the first punch 40, as shown in FIG. 26. This makes the blank 5 forced into the first hole 33*a* of the first insert 33 and pressed by the first end portion 38*a* of the first pin 38, resulting in a preliminary form of the pilot portion 6 on a lower portion of the blank 5. Also, the preliminary form of the pilot portion 6 is pressed by the first chamfer 33*c* of the first insert 33.

When the blank 5 is pressed into the first surrounding groove 36, the surrounding wall 7 is preliminarily formed around the pilot portion 6. The distal end 42 of the first punch 40 presses an upper portion of the blank 5 to form a provisional dent 9*b*, which is a preliminary form of the penetrating hole.

When the first punch 40 is moved away from the first processing space 35 and the first pin 38 is moved upward, the blank done with the first processing is discharged from the first processing space 35. When the blank 5 is discharged from the first processing space 35, the blank 5 is transferred from the first forging die assembly 30 to the second forging die assembly 50 using the gripper 26*b* of the transfer mechanism 25.

Next, in the second processing, the blank 5 is now transferred from the first processing space 35 and disposed in the second processing space 55. In the second processing space 55, the blank 5 is clamped between the second insert 53 and the second pin 58, and the second punch 60, as shown in FIG. 27. As shown in FIG. 15, the inner peripheral length of the second inner peripheral wall 52*b* in the second surrounding groove 56 decreases gradually as the distance from the second punch 60 increases. Thus, as shown in FIG. 27, the surrounding wall 7 of the blank 5 inserted in the second surrounding groove 56 is inclined toward the pilot portion 6.

Also, the preliminary form of pilot portion 6, which has been formed in the first processing, is widened in a horizontal direction (X axis direction). In a manner similar to the first processing, the preliminary form of the pilot portion 6 is pressed by the second chamfer 53*c* of the second insert 53. The distal end 62 of the second punch 60 presses an upper portion of the blank 5 in a manner similar to the first processing.

When the second punch 60 is moved away from the second processing space 55 and the second pin 58 is moved upward, the blank 5 done with the second processing is discharged from the second processing space 55. When the blank 5 is discharged from the second processing space 55, the blank 5 is transferred from the second forging die assembly 50 to the third forging die assembly 70 using the gripper 26*c* of the transfer mechanism 25.

Next, in the third processing, the blank 5 is now transferred from the second processing space 55 and disposed in the third processing space 75. In the third processing space 75, the blank 5 is clamped between the guide 73 and the third punch 80, and the fourth punch 85, as shown in FIG. 28. Thus, a portion of the blank 5 adjacent to its axis is moved upward and clamped between the distal end 82 of the third punch 80 and the fourth punch 85. Consequently, the provisional dent 9*b* (see FIGS. 26 and 27), which has been formed in the first processing and the second processing, is penetrated to result in the through hole 9*a* along the direction (Z axis direction) in which the distal end 82 proceeds. When the portion of the blank 5 adjacent to its axis is moved upward, an outer peripheral wall of the pilot portion 6 is inclined toward the surrounding wall 7 due to the upward movement effect.

As shown in FIGS. 23 and 24, the outer diameter of the shank 81 is set at a first outer diameter ED1, which is approximately equal to an inner diameter ID of the third hole 73*a*. The outer diameter of the distal end 82 is set at a second outer diameter ED2, which is smaller than the first outer diameter ED1. A third outer diameter ED3 of the inclined portion 83 is defined at the first connection position CP1 by the distal end 82. The third outer diameter ED3 is approximately equal to the second outer diameter ED2. A fourth outer diameter ED4 of the inclined portion 83 is defined at the second connection position CP2 by the shank 81. The fourth outer diameter ED4 is approximately equal to the first outer diameter ED1.

Thus, when the blank 5 disposed in the third processing space 75 is clamped between the guide 73 and the third punch 80, and the fourth punch 85, the pilot portion 6 of the blank 5 inserted in the third hole 73*a* is pressed by the outer peripheral surface 83*a* of the inclined portion 83.

Thus, the pilot portion 6 is precisely processed mainly by punching and pressing from the inclined portion 83 and the shank 81, and inclined toward the surrounding wall 7. When the third punch 80 is moved away from the third processing space 75 and the plurality of third pins 88 are moved upward, the blank 5 done with the third processing is discharged from the third processing space 75. The blank 5 discharged from the third processing space 75 is transferred from the third forging die assembly 70 to a device in charge of a subsequent process by a transfer mechanism, not shown.

At the timing when the second processing has been completed, the height of the annular protrusion 74 from the opposed surface 73*d* is set at a height SH1 (see FIG. 23), which is larger than at least the height of the surrounding wall 7 of the blank 5 (that is, the height of the surrounding wall 7 from the flat surface 8*a* surrounded by the pilot portion 6 and the surrounding wall 7; see FIG. 3). This eliminates or minimizes contact of the surrounding wall 7 of the blank 5 with the opposed surface 73*d* of the guide 73 in the third processing. In other words, processing of the surrounding wall 7 is eliminated or minimized in the third processing. This further improves processing precision of the pilot portion 6 and the surrounding wall 7.

7. Advantages of the Production Apparatus According to this Embodiment

As has been described hereinbefore, the production apparatus 1 according to this embodiment performs the following processing steps:

(1) in the first processing in the first processing space 35 of the first forging die assembly 30, mainly, the pilot portion 6 and the surrounding wall 7 are preliminarily formed on the blank 5 (see FIG. 26);

(2) in the second processing in the second processing space 55 of the second forging die assembly 50, mainly, the surrounding wall 7 of the blank 5 is inclined toward the pilot portion 6 (see FIG. 27); and (3) in the third processing in the third processing space 75 of the third forging die assembly 70, mainly, the through hole 9*a* is formed in the pilot portion 6, and at the same time, the pilot portion 6 is inclined toward the surrounding wall 7.

In the third processing, contact of the surrounding wall 7 of the blank 5 with the opposed surface 73*d* of the guide 73 is prevented or minimized. This ensures that inclination of the pilot portion 6 and inclination of the surrounding wall 7 are performed in different steps. This further improves processing precision of the pilot portion 6 and the surrounding wall 7.

In the production apparatus 1 according to this embodiment, punching is performed in the final step. This ensures that even if the blank 5 that has not reached the final step is erroneously discharged to the subsequent process, the defective blank is caught by error management included tapping processing in the subsequent process. That is, a blank 5 without through hole 9*a* cannot undergo tapping in the first place.

Thus, the production apparatus 1 according to this embodiment performs punching in the final step. This reliably eliminates production of a self-piercing and clinch nut 4 that has not been subjected to the first processing and/or the second processing.

In the production apparatus 1 according to this embodiment, the first hole 33*a* is formed in the first insert 33. The portion of the first insert 33 adjacent to the first opening 33*b* of the first hole 33*a* on the first platform 34 side is chamfered flatly to form the first chamfer 33*c*. The second hole 53*a* is formed in the second insert 53. The portion of the second insert 53 adjacent to the second opening 53*b* of the second hole 53*a* on the second platform 54 side is chamfered flatly to form the second chamfer 53*c* in the manner similar to the case of the first opening 33*b*.

Thus, the preliminary form of the pilot portion 6 of the blank 5 is pressed by the first chamfer 33*c* of the first insert 33 and the second chamfer 53*c* of the second insert 53, and inclined toward the surrounding wall 7. This ensures that the resulting self-piercing and clinch nut 4 has a sufficiently large thickness TH1 of the thick portion 9 on the outer periphery of the through hole 9*a* adjacent to the flat surface 8*a* (see FIG. 3).

The use of the self-piercing and clinch nut 4 produced by the production apparatus 1 according to this embodiment ensures that the pilot portion 6 and the thick portion 9 are prevented from buckling due to compressive stress in the pilot portion 6 and the thick portion 9 at the time of punching of the parent material.

The use of the self-piercing and clinch nut 4 produced by the production apparatus 1 according to this embodiment ensures that when the parent material is deformed to fill the gap between the pilot portion 6 and the surrounding wall 7 to clinch the parent material by the self-piercing and clinch nut 4, the diameter of the through hole 9*a* of the self-piercing and clinch nut 4 is prevented from changing. This eliminates or minimizes such an occurrence that the self-piercing and clinch nut 4 cannot receive a screw after the self-piercing and clinch nut 4 has been secured on the parent material.

In the production apparatus 1 according to this embodiment, the feeder 3 feeds to the forger 10 a wire material having an approximately rectangular cross-section as a material of the blank 5. This saves the first to third dies 30, 50, 70 the load involved in forging the blank 5 for the self-piercing and clinch nut 4 having an approximately rectangular external shape. This elongates the intervals for maintenance of the first to third dies 30, 50, 70, resulting in elongated service life of the first to third dies 30, 50, 70.

8. Modifications

The embodiment described so far should not be construed as limiting the present invention, but can be modified in various manners.

(1) In the description of this embodiment, the first chamfer 33*c* of the first insert 33 and the second chamfer 53*c* of the second insert 53 are flat. This, however, should not be construed in a limiting sense. Another possible example is that the first and second chamfers 33*c* and 53*c* are curved surfaces having predetermined curvatures.

(2) In the description of this embodiment, the inclination of the first chamfer 33*c* and the inclination of the second chamfer 53*c* are approximately uniform. This, however, should not be construed in a limiting sense. The inclination of the first chamfer 33*c* and the inclination of the second chamfer 53*c* may vary.

(3) In the description of this embodiment, the first punch 40 includes the shank 41 and the distal end 42 integral with each other. This, however, should not be construed in a limiting sense. Another example is that a rod-shaped pin is fitted in a cylindrical punch to constitute the first punch 40. That is, different elements may be combined to constitute the first punch 40. Similarly, different elements may be combined to constitute the second punch 60.

(4) In the description of the second processing in the second forging die assembly 50 according to this embodiment, the blank 5 is clamped between the second insert 53 and the second pin 58, and the second punch 60. This, however, should not be construed in a limiting sense. Another possible example is that in the second processing the second pin 58 is moved downward to a withdrawal position (position indicated by the chain double-dashed line in FIG. 27). In the second processing of this case, the blank 5 is clamped between the second insert 53 and the second punch 60.

(5) In the description of this embodiment, the first punch 40 is movable to and away from the first processing space 35. This, however, should not be construed in a limiting sense. The first die 32 and the first insert 33 may be movable to and away from the first punch 40, or all of the first die 32, the first insert 33, and the first punch 40 may be movable to and away from each other. It may suffice that the first punch 40 is movable to and away from the first processing space 35.

The same applies to the first pin 38, the second pin 58, the second punch 60, the fourth punch 85, and the plurality of third pins 88. That is, it may suffice that the first pin 38 is movable to and away from the first processing space 35, the second pin 58 and the second punch 60 are movable to and away from the second processing space 55, and the fourth punch 85 and the plurality of the third pins 88 are movable to and away from the third processing space 75.

(6) In the description of this embodiment, the number of the plurality of third pins 88 is four. This, however, should not be construed as limiting the number of the third pins 88. Insofar as the blank 5 is reliably discharged from the third processing space 75, the number of the third pins 88 may be three, or five or more.

(7) In the description of this embodiment, the third die 72 and the guide 73 are different elements. This, however, should not be construed in a limiting sense. These elements 72 and 73 may be integral with each other.

According to one aspect of the embodiment of the present invention, an apparatus to produce a self-piercing and clinch nut includes a first forging die assembly, a second forging die assembly, a third forging die assembly, a transfer mechanism, and a controller. The first forging die assembly is configured to subject a blank to first processing. The first forging die assembly includes a first die, a first cylindrical insert, a first punch, and a first pin. The first die includes a first insert hole and a first inner peripheral wall defining the first insert hole. The first cylindrical insert includes a first platform. The first cylindrical insert is fitted in the first insert hole with the first platform opposed to the blank so as to define a first processing space in which the blank is to be processed. The first platform includes a first side wall. The first side wall and the first inner peripheral wall define a first surrounding groove. The first punch is movable to and away from the first processing space. The first pin is fitted in a first hole of the first insert. The second forging die assembly is adjacent to the first forging die assembly and is configured to subject the blank to second processing after the blank has undergone the first processing in the first forging die assembly. The second forging die assembly includes a second die, a second cylindrical insert, and a second punch. The second die includes a second insert hole and a second inner peripheral wall defining the second insert hole. The second cylindrical insert includes a second platform. The second cylindrical insert is fitted in the second insert hole with the second platform opposed to the blank so as to define a second processing space in which the blank is to be processed. The second platform includes a second side wall. The second side wall and the second inner peripheral wall define a second surrounding groove. The second punch is movable to and away from the second processing space. An inner peripheral length of the second inner peripheral wall in the second surrounding groove decreases as a distance from the second punch increases. The third forging die assembly is adjacent to the second forging die assembly and is configured to subject the blank to third processing after the blank has undergone the second processing in the second forging die assembly. The third forging die assembly includes a third die, a cylindrical guide, and a third punch. The third die includes a third insert hole. The cylindrical guide includes a third hole. The cylindrical guide includes an annular protrusion along an opening of the third hole. The annular protrusion is inserted in the third insert hole to define a third processing space. The annular protrusion is formed on an opposed surface opposed to the blank. A height of the annular protrusion from the opposed surface is larger than at least a height of a surrounding wall of the blank. The third punch is fitted in the third hole. The third punch includes a rod-shaped shank, a rod-shaped distal end, and an inclined frustum portion. The rod-shaped distal end is closer to the blank than the shank is to the blank. The inclined frustum portion is between the shank and the distal end. The fourth cylindrical punch is movable to and away from the third processing space. The fourth cylindrical punch is configured to clamp the blank between the third punch and the fourth cylindrical punch so as to define a through hole in the blank. The transfer mechanism is configured to transfer the blank between adjacent two forging die assemblies among the first forging die assembly, the second forging die assembly, and the third forging die assembly. The controller is configured to control the first forging die assembly, the second forging die assembly, the third forging die assembly, and the transfer mechanism to operate. The controller is configured to clamp the blank in the first processing space between the first pin and the first insert, and the first punch so as to press the blank forced in the first hole of the first insert using a first end portion of the first pin to form a pilot portion on the blank, and so as to form the blank forced in the first surrounding groove into the surrounding wall surrounding the pilot portion. The controller is configured to clamp the blank in the second processing space between the second insert and the second punch so as to incline the surrounding wall inserted in the second surrounding groove toward the pilot portion. The controller is configured to clamp the blank in the third processing space between the guide and the third punch, and the fourth punch so as to form the through hole in the blank and incline the pilot portion toward the surrounding wall.

According to another aspect of the embodiment of the present invention, an apparatus to produce a self-piercing and clinch nut includes a first forging die assembly, a second forging die assembly, a third forging die assembly, and a transfer mechanism. The first forging die assembly is configured to subject a blank to first processing. The first forging die assembly includes a first die, a first cylindrical insert, a first punch, and a first pin. The first die includes a first insert hole and a first inner peripheral wall defining the first insert hole. The first cylindrical insert includes a first platform. The first cylindrical insert is fitted in the first insert hole with the first platform opposed to the blank so as to define a first processing space in which the blank is to be processed. The first platform includes a first side wall. The first side wall and the first inner peripheral wall define a first surrounding groove. The first punch is movable to and away from the first processing space. The first pin is fitted in a first hole of the first insert. The second forging die assembly is adjacent to the first forging die assembly and is configured to subject the blank to second processing after the blank has undergone the first processing in the first forging die assembly. The second forging die assembly includes a second die, a second cylindrical insert, and a second punch. The second die includes a second insert hole and a second inner peripheral wall defining the second insert hole. The second cylindrical insert includes a second platform. The second cylindrical insert is fitted in the second insert hole with the second platform opposed to the blank so as to define a second processing space in which the blank is to be processed. The second platform includes a second side wall. The second side wall and the second inner peripheral wall define a second surrounding groove. The second punch is movable to and away from the second processing space. An inner peripheral length of the second inner peripheral wall in the second surrounding groove decreases as a distance from the second punch increases. The third forging die assembly is adjacent to the second forging die assembly and is configured to subject the blank to third processing after the blank has undergone the second processing in the second forging die assembly. The third forging die assembly includes a third die, a cylindrical guide, and a third punch. The third die includes a third insert hole. The cylindrical guide includes a third hole. The cylindrical guide includes an annular protrusion along an opening of the third hole. The annular protrusion is inserted in the third insert hole to define a third processing space. The annular protrusion is formed on an opposed surface opposed to the blank. A height of the annular protrusion from the opposed surface is larger than at least a height of a surrounding wall of the blank. The third punch is fitted in the third hole. The third punch includes a rod-shaped shank, a rod-shaped distal end, and an inclined frustum portion. The rod-shaped distal end is closer to the blank than the shank is to the blank. The inclined frustum portion is between the shank and the distal end. The fourth cylindrical punch is movable to and away from the third processing space. The fourth cylindrical punch is configured to clamp the blank between the third punch and the fourth cylindrical punch so as to define a through hole in the blank. The transfer mechanism is configured to transfer the blank between adjacent two forging die assemblies among the first forging die assembly, the second forging die assembly, and the third forging die assembly.

According to the other aspect of the embodiment of the present invention, a method is for producing a self-piercing and clinch nut using a first forging die assembly, a second forging die assembly, and a third forging die assembly. The first forging die assembly includes a first die, a first cylindrical insert, a first punch, and a first pin. The first die includes a first insert hole and a first inner peripheral wall defining the first insert hole. The first cylindrical insert includes a first platform. The first cylindrical insert is fitted in the first insert hole with the first platform opposed to a blank so as to define a first processing space in which the blank is to be processed. The first platform includes a first side wall. The first side wall and the first inner peripheral wall define a first surrounding groove. The first punch is movable to and away from the first processing space. The first pin is fitted in a first hole of the first insert. The second forging die assembly is adjacent to the first forging die assembly and is configured to subject the blank to second processing after the blank has undergone the first processing in the first forging die assembly. The second forging die assembly includes a second die, a second cylindrical insert, and a second punch. The second die includes a second insert hole and a second inner peripheral wall defining the second insert hole. The second cylindrical insert includes a second platform. The second cylindrical insert is fitted in the second insert hole with the second platform opposed to the blank so as to define a second processing space in which the blank is to be processed. The second platform includes a second side wall. The second side wall and the second inner peripheral wall define a second surrounding groove. The second punch is movable to and away from the second processing space. An inner peripheral length of the second inner peripheral wall in the second surrounding groove decreases as a distance from the second punch increases. The third forging die assembly is adjacent to the second forging die assembly and is configured to subject the blank to third processing after the blank has undergone the second processing in the second forging die assembly. The third forging die assembly includes a third die, a cylindrical guide, and a third punch. The third die includes a third insert hole. The cylindrical guide includes a third hole. The cylindrical guide includes an annular protrusion along an opening of the third hole. The annular protrusion is inserted in the third insert hole to define a third processing space. The annular protrusion is formed on an opposed surface opposed to the blank. A height of the annular protrusion from the opposed surface is larger than at least a height of a surrounding wall of the blank. The third punch is fitted in the third hole. The third punch includes a rod-shaped shank, a rod-shaped distal end, and an inclined frustum portion. The rod-shaped distal end is closer to the blank than the shank is to the blank. The inclined frustum portion is between the shank and the distal end. The fourth cylindrical punch is movable to and away from the third processing space. The fourth cylindrical punch is configured to clamp the blank between the third punch and the fourth cylindrical punch so as to define a through hole in the blank. The method includes providing the blank in the first processing space. After the blank has been provided in the first processing space, the blank is clamped between the first pin and the first insert, and the first punch so as to press the blank forced in the first hole of the first insert using a first end portion of the first pin to form a pilot portion on the blank and to form the blank forced in the first surrounding groove into a surrounding wall surrounding the pilot portion. After the blank has been clamped between the first pin and the first insert, and the first punch, the blank is provided in the second processing space. After the blank has been provided in the second processing space, the blank is clamped between the second insert and the second punch so as to incline the surrounding wall inserted in the second surrounding groove toward the pilot portion. After the blank has been clamped between the second insert and the second punch, the blank is provided in the third processing space. After the blank has been provided in the third processing space, the blank is clamped between the guide and the third punch, and the fourth punch so as to form the through hole and to incline the pilot portion toward the surrounding wall.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus to produce a self-piercing and clinch nut, the apparatus comprising:

a first forging die assembly configured to subject a blank to first processing, the first forging die assembly comprising:

a first die comprising a first insert hole and a first inner peripheral wall defining the first insert hole;

a first cylindrical insert comprising a first platform, the first cylindrical insert being fitted in the first insert hole with the first platform opposed to the blank so as to define a first processing space in which the blank is to be processed, the first platform comprising a first side wall, the first side wall and the first inner peripheral wall defining a first surrounding groove;

a first punch movable to and away from the first processing space; and a first pin fitted in a first hole of the first cylindrical insert;

a second forging die assembly adjacent to the first forging die assembly and configured to subject the blank to second processing after the blank has undergone the first processing in the first forging die assembly, the second forging die assembly comprising:

a second die comprising a second insert hole and a second inner peripheral wall defining the second insert hole;

a second cylindrical insert comprising a second platform, the second cylindrical insert being fitted in the second insert hole with the second platform opposed to the blank so as to define a second processing space in which the blank is to be processed, the second platform comprising a second side wall, the second side wall and the second inner peripheral wall defining a second surrounding groove; and a second punch movable to and away from the second processing space, an inner peripheral length of the second inner peripheral wall in the second surrounding groove decreasing as a distance from the second punch increases;

a third forging die assembly adjacent to the second forging die assembly and configured to subject the blank to third processing after the blank has undergone the second processing in the second forging die assembly, the third forging die assembly comprising:

a third die comprising a third insert hole;

a cylindrical guide comprising a third hole, the cylindrical guide comprising an annular protrusion along an opening of the third hole, the annular protrusion being inserted in the third insert hole to define a third processing space, the annular protrusion being provided on an opposed surface opposed to the blank, a height of the annular protrusion from the opposed surface being larger than at least a height of a surrounding wall of the blank; and a third punch fitted in the third hole and comprising:

a rod-shaped shank;

a rod-shaped distal end closer to the blank than the rod-shaped shank; and an inclined frustum portion between the rod-shaped shank and the rod-shaped distal end; and a fourth cylindrical punch movable to and away from the third processing space, the fourth cylindrical punch being configured to clamp the blank between the third punch and the fourth cylindrical punch so as to define a through hole in the blank;

a transfer mechanism configured to transfer the blank between adjacent two forging die assemblies among the first forging die assembly, the second forging die assembly, and the third forging die assembly; and a controller configured to control the first forging die assembly, the second forging die assembly, the third forging die assembly, and the transfer mechanism to operate, the controller being configured to clamp the blank in the first processing space between the first pin, the first cylindrical insert, and the first punch so as to press the blank forced in the first hole of the first cylindrical insert using a first end portion of the first pin to provide a pilot portion on the blank, and so as to provide the blank forced in the first surrounding groove with the surrounding wall surrounding the pilot portion, the controller being configured to clamp the blank in the second processing space between the second cylindrical insert and the second punch so as to incline the surrounding wall inserted in the second surrounding groove toward the pilot portion, the controller being configured to clamp the blank in the third processing space between the cylindrical guide, the third punch, and the fourth cylindrical punch so as to provide the through hole in the blank and incline the pilot portion toward the surrounding wall.

2. An apparatus to produce a self-piercing and clinch nut, the apparatus comprising:

a first forging die assembly configured to subject a blank to first processing, the first forging die assembly comprising:

a first die comprising a first insert hole and a first inner peripheral wall defining the first insert hole;

a first cylindrical insert comprising a first platform, the first cylindrical insert being fitted in the first insert hole with the first platform opposed to the blank so as to define a first processing space in which the blank is to be processed, the first platform comprising a first side wall, the first side wall and the first inner peripheral wall defining a first surrounding groove;

a first punch movable to and away from the first processing space; and a first pin fitted in a first hole of the first cylindrical insert;

a second forging die assembly adjacent to the first forging die assembly and configured to subject the blank to second processing after the blank has undergone the first processing in the first forging die assembly, the second forging die assembly comprising:

a second die comprising a second insert hole and a second inner peripheral wall defining the second insert hole;

a second cylindrical insert comprising a second platform, the second cylindrical insert being fitted in the second insert hole with the second platform opposed to the blank so as to define a second processing space in which the blank is to be processed, the second platform comprising a second side wall, the second side wall and the second inner peripheral wall defining a second surrounding groove; and a second punch movable to and away from the second processing space, an inner peripheral length of the second inner peripheral wall in the second surrounding groove decreasing as a distance from the second punch increases;

a third forging die assembly adjacent to the second forging die assembly and configured to subject the blank to third processing after the blank has undergone the second processing in the second forging die assembly, the third forging die assembly comprising:

a third die comprising a third insert hole;

a cylindrical guide comprising a third hole, the cylindrical guide comprising an annular protrusion along an opening of the third hole, the annular protrusion being inserted in the third insert hole to define a third processing space, the annular protrusion being provided on an opposed surface opposed to the blank, a height of the annular protrusion from the opposed surface being larger than at least a height of a surrounding wall of the blank; and a third punch fitted in the third hole and comprising:

a rod-shaped shank;

a rod-shaped distal end closer to the blank than the rod-shaped shank; and an inclined frustum portion between the rod-shaped shank and the rod-shaped distal end; and a fourth cylindrical punch movable to and away from the third processing space, the fourth cylindrical punch being configured to clamp the blank between the third punch and the fourth cylindrical punch so as to define a through hole in the blank; and a transfer mechanism configured to transfer the blank between adjacent two forging die assemblies among the first forging die assembly, the second forging die assembly, and the third forging die assembly.

3. The apparatus according to claim 1, wherein a portion of the first cylindrical insert adjacent to a first opening of the first hole on a side of the first platform is chamfered to provide a first chamfer, wherein a portion of the second cylindrical insert adjacent to a second opening of a second hole on a side of the second platform is chamfered to provide a second chamfer, and wherein in the first processing, the controller is configured to press a preliminary form of the pilot portion of the blank onto the first chamfer of the first cylindrical insert, and wherein in the second processing, the controller is configured to press the preliminary form of the pilot portion of the blank onto the second chamfer of the second cylindrical insert.

4. The apparatus according to claim 2, wherein a portion of the first cylindrical insert adjacent to a first opening of the first hole on a side of the first platform is chamfered, and wherein a portion of the second cylindrical insert adjacent to a second opening of a second hole on a side of the second platform is chamfered.

5. The apparatus according to claim 1, wherein the inclined frustum portion comprises an outer diameter that gradually increases from a first connection position to a second connection position.

6. The apparatus according to claim 2, wherein the inclined frustum portion comprises an outer diameter that gradually increases from a first connection position to a second connection position.

7. The apparatus according to claim 1, further comprising:

a forger configured to produce the blank for a self-piercing and clinch nut that has an approximately rectangular external shape, the forger comprising the first forging die assembly, the second forging die assembly, the third forging die assembly, and the transfer mechanism; and a feeder configured to feed to the forger a wire material having an approximately rectangular cross-section as a material of the blank.

8. The apparatus according to claim 2, further comprising:

a forger configured to produce the blank for a self-piercing and clinch nut that has an approximately rectangular external shape, the forger comprising the first forging die assembly, the second forging die assembly, the third forging die assembly, and the transfer mechanism; and a feeder configured to feed to the forger a wire material having an approximately rectangular cross-section as a material of the blank.

9. The apparatus according to claim 1, wherein the third forging die assembly further comprises at least three knockout pins disposed along a third inner peripheral wall defining the third insert hole, the at least three knockout pins being movable to and away from the third processing space.

10. The apparatus according to claim 2, wherein the third forging die assembly further comprises at least three knockout pins disposed along a third inner peripheral wall defining the third insert hole, the at least three knockout pins being movable to and away from the third processing space.

11. A method for producing a self-piercing and clinch nut, the method comprising:

providing a first forging die assembly, a second forging die assembly, and a third forging die assembly, the first forging die assembly comprising:

a first die comprising a first insert hole and a first inner peripheral wall defining the first insert hole;

a first cylindrical insert comprising a first platform, the first cylindrical insert being fitted in the first insert hole with the first platform opposed to a blank so as to define a first processing space in which the blank is to be processed, the first platform comprising a first side wall, the first side wall and the first inner peripheral wall defining a first surrounding groove;

a first punch movable to and away from the first processing space; and a first pin fitted in a first hole of the first cylindrical insert, the second forging die assembly comprising:

a second die comprising a second insert hole and a second inner peripheral wall defining the second insert hole;

a second cylindrical insert comprising a second platform, the second cylindrical insert being fitted in the second insert hole with the second platform opposed to the blank so as to define a second processing space in which the blank is to be processed, the second platform comprising a second side wall, the second side wall and the second inner peripheral wall defining a second surrounding groove; and a second punch movable to and away from the second processing space, an inner peripheral length of the second inner peripheral wall in the second surrounding groove decreasing as a distance from the second punch increases, the third forging die assembly comprising:

a third die comprising a third insert hole;

a cylindrical guide comprising a third hole, the cylindrical guide comprising an annular protrusion along an opening of the third hole, the annular protrusion being inserted in the third insert hole to define a third processing space, the annular protrusion being provided on an opposed surface opposed to the blank, a height of the annular protrusion from the opposed surface being larger than at least a height of a surrounding wall of the blank;

a third punch fitted in the third hole and comprising:

a rod-shaped shank;

a rod-shaped distal end closer to the blank than the rod-shaped shank; and an inclined frustum portion between the rod-shaped shank and the rod-shaped distal end; and a fourth cylindrical punch movable to and away from the third processing space, the fourth cylindrical punch being configured to clamp the blank between the third punch and the fourth cylindrical punch so as to define a through hole in the blank;

providing the blank in the first processing space;

after the blank has been provided in the first processing space, clamping the blank between the first pin, the first cylindrical insert, and the first punch so as to press the blank forced in the first hole of the first cylindrical insert using a first end portion of the first pin to provide a pilot portion on the blank and to provide the blank forced in the first surrounding groove with the surrounding wall surrounding the pilot portion;

after the blank has been clamped between the first pin, the first cylindrical insert, and the first punch, providing the blank in the second processing space;

after the blank has been provided in the second processing space, clamping the blank between the second cylindrical insert and the second punch so as to incline the surrounding wall inserted in the second surrounding groove toward the pilot portion;

after the blank has been clamped between the second cylindrical insert and the second punch, providing the blank in the third processing space; and after the blank has been provided in the third processing space, clamping the blank between the cylindrical guide, the third punch, and the fourth cylindrical punch so as to provide the through hole and to incline the pilot portion toward the surrounding wall.

12. The method according to claim 11, wherein a portion of the first cylindrical insert adjacent to a first opening of the first hole on a side of the first platform is chamfered to provide a first chamfer, wherein a portion of the second cylindrical insert adjacent to a second opening of a second hole on a side of the second platform is chamfered to provide a second chamfer, wherein the clamping the blank between the first pin, the first cylindrical insert, and the first punch comprises pressing a preliminary form of the pilot portion of the blank onto the first chamfer of the first cylindrical insert, and wherein the clamping the blank between the second cylindrical insert and the second punch comprises pressing the preliminary form of the pilot portion onto the second chamfer of the second cylindrical insert.

* * * * *

(12) SUPPLEMENTAL EXAMINATION CERTIFICATE

United States Patent (10) Number: US 8,899,089 F1

Shinjo (45) Certificate Issued: Jul. 6, 2015

Control No.: 96/000,090 Filing Date: May 12, 2015

Primary Examiner: Jeffrey L. Gellner

No substantial new question of patentability is raised in the request for supplemental examination. See the Reasons for Substantial New Question of Patentability Determination in the file of this proceeding.

(56) Items of Information

U.S. PATENT DOCUMENTS

| | | |
|---|---|---|
| 3,793,658 | 2/1974 | Ladouceur |
| 5,618,237 | 4/1997 | Shinjo |
| 7,314,417 | 1/2008 | Babej et al. |
| 2012/0316001 | 12/2012 | Shinjo |

FOREIGN PATENT DOCUMENTS

| | | |
|---|---|---|
| JP | 07-171654 | 7/1995 |
| EP | 1559488 | 8/2008 |
| JP | 2012-250279 | 12/2012 |

OTHER DOCUMENTS

Notification of Reasons for Refusal for corresponding Japanese patent application No. 2014-135592, 30 October 2014.